US009033336B2

(12) United States Patent
Washino

(10) Patent No.: US 9,033,336 B2
(45) Date of Patent: May 19, 2015

(54) FEED TRAY

(71) Applicant: BROTHER KOGYO KABUSHIKI KAISHA, Nagoya-shi, Aichi-ken (JP)

(72) Inventor: Yoshiyuki Washino, Gifu-Ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/452,017

(22) Filed: Aug. 5, 2014

(65) Prior Publication Data

US 2015/0042036 A1 Feb. 12, 2015

(51) Int. Cl.

| | |
|---|---|
| ***B65H 1/04*** | (2006.01) |
| ***B65H 1/08*** | (2006.01) |
| ***B65H 1/26*** | (2006.01) |

(52) U.S. Cl.

CPC .. *B65H 1/04* (2013.01); *B65H 1/08* (2013.01); *B65H 1/26* (2013.01); *B65H 2405/1122* (2013.01)

(58) Field of Classification Search

CPC ..... B65H 1/04; B65H 2405/1122; B65H 2405/121; B65H 2511/11

See application file for complete search history.

(56) References Cited

U.S. PATENT DOCUMENTS

2012/0235345 A1 9/2012 Shiota

FOREIGN PATENT DOCUMENTS

| | | | |
|---|---|---|---|
| JP | 2006-008377 | A | 1/2006 |
| JP | 2012-197129 | A | 10/2012 |

*Primary Examiner* — Michael McCullough

(74) *Attorney, Agent, or Firm* — Merchant & Gould PC

(57) ABSTRACT

A feed tray includes a first tray, a second tray movable relative to the first tray between a first position, a second position and a third position located therebetween, and a lock mechanism capable of locking the second tray. The lock mechanism includes a moving member movable to a second set position and a locking position to lock the second tray, and a guide portion configured to contact with a projection provided on the moving member. The guide portion guides the projection at the second set position to be situated at the locking position when the second tray is located at the first position or the second position, but does not guide the projection to the locking position with the second tray located at the third position in the course of moving the second tray to the first or second position.

11 Claims, 11 Drawing Sheets

FEED TRAY

CROSS REFERENCE TO RELATED APPLICATION

The present application claims priority from Japanese Patent Application No. 2013-164590, filed on Aug. 7, 2013, the disclosure of which is incorporated herein by reference in its entirety.

BACKGROUND

1. Field of the Invention

The present invention relates to a feed tray used to support sheets to be fed to a device.

2. Description of the Related Art

Conventionally, there are apparatuses configured to convey sheets in the inside thereof. Examples of such apparatuses include image recording devices such as copy machines and printers. Some of the image recording devices include a paper feed cassette on which sheets to be fed to the inside thereof can be stacked. Further, downsizing of the image recording devices is required in recent years. If an image recording device is downsized, then the paper feed cassette installed in the image recording device is also downsized. As a result, it becomes difficult for the paper feed cassette installed in the image recording device to load large-size sheets.

In order to solve the above problem, there is known a paper feed cassette which includes a base portion and a slide portion wherein the slide portion is movable in a put-in/pull-out direction relative to the base portion. This paper feed cassette can be lengthened or shortened by moving the slide portion, thereby causing the slide portion to lengthen relative to the base portion when large-size sheets are loaded in the paper feed cassette.

Further, the paper feed cassette includes a lock mechanism configured to lock the movement of the slide portion. The lock mechanism includes a plurality of lock grooves each of which are separately placed in the moving direction of the slide portion, lock pieces for moving in a direction orthogonal to the moving direction of the slide portion so as to engage with the lock grooves, and a biasing member for biasing the lock pieces toward the positions of engaging with the lock grooves. By virtue of this, when moving the slide portion, if the lock pieces move to the positions at which the respective lock grooves are formed, then the lock pieces engage with the lock groves due to the biasing member. That is, the paper feed cassette mentioned above is capable of automatically locking the movement of the slide portion by the biasing means.

SUMMARY

However, in the paper feed cassette as described above, such a problem arises that each time the lock pieces reach the respective positions of the plurality of lock grooves, even if those positions are undesirable positions for a user to lock the slide portion, it is still locked because of the biasing member. If the lock grooves are provided only in two places, then because the slide portion has to move from the position of one lock groove to the position of the other lock groove, that problem will not arise. However, if the lock grooves are provided in three places or more, then that problem will arise.

The present teaching is made in view of the above problem, and an object thereof is to provide a feed tray capable of locking the feed tray to stop the same from lengthening and shortening in a position according to a desired sheet size.

According to an aspect of the present teaching, there is provided a feed tray including: a first tray including a first support surface configured to support a sheet;

a second tray including a second support surface configured to support the sheet, and being configured to be movable among a first position, a second position and a third position;

the first position being a position at which the second support surface overlaps with the first support surface, the second position being a position at which an area of the second support surface overlapping with the first support surface is smaller than in the first position, and the third position being a position at which the area of the second support surface overlapping with the first support surface is smaller than in the first position but larger than in the second position; and a lock mechanism configured to lock the second tray to stop the second tray from moving, wherein the lock mechanism comprises:

a moving member supported by one of the first tray and the second tray, and configured to move in an intersectant direction intersecting a moving direction of the second tray;

an engaging portion provided on the moving member and configured to engage with the other of the second tray and the first tray;

an engaging-target portion provided on the other of the second tray and the first tray and configured to engage with the engaging portion to lock the second tray to stop the second tray from moving;

a moving portion configured to move with the moving member among a locking position at which the engaging portion is engageable with the engaging-target portion, a first set position at which the engaging portion does not engage with the engaging-target portion, and a second set position which is different from the first set position and at which the engaging portion does not engage with the engaging-target portion either; and a guide portion provided on the other of the second tray and the first tray to guide the moving portion to the locking position in the course of movement of the second tray, wherein the engaging-target portion comprises:

a first engaging-target portion engaging with the engaging portion with the second tray located at the first position and with the moving portion located at the locking position;

a second engaging-target portion engaging with the engaging portion with the second tray located at the second position and with the moving portion located at the locking position; and a third engaging-target portion engaging with the engaging portion with the second tray located at the third position and with the moving portion located at the locking position, wherein the guide portion comprises:

a first guide portion configured to guide the moving portion at the first set position to the locking position in the course of the second tray moving from the first position or the second position to the third position; and a second guide portion configured to guide the moving portion at the second set position to the locking position in a case that the second tray moves to the first position or the second position, but not to guide the moving portion at the second set position to the locking position with the second tray located at the third position, in the course of the second tray moving from the second position or the third position to the first position, and in the course of the second tray moving from the first position or the third position to the second position.

When a user moves the second tray from the first position or the second position to the third position, then at first the moving member is moved to cause the moving portion to move from the locking position to the first set position. By virtue of this, the second tray is released from being locked and stopped from moving relative to the first tray. Next, the second tray is moved to the third position. At this time, the moving portion is guided by the first guide portion from the first set position to the locking position. As a result, the engaging portion provided on the moving member engages with the third engaging-target portion so as to lock the second tray in the third position to stop the second tray from moving relative to the first tray.

On the other hand, when the user moves the second tray from the first position to the second position, from the second position to the first position, from the third position to the first position, or from the third position to the second position, then at first the moving member is moved to cause the moving portion to move from the locking position to the second set position. By virtue of this, the second tray is released from being locked and stopped from moving relative to the first tray. Next, the second tray is moved to the first position or the second position. At this time, the moving portion is guided by the second guide portion from the second set position to the locking position. As a result, the engaging portion provided on the moving member engages with the first engaging-target portion or the second engaging-target portion so as to lock the second tray in the first position or in the second position to stop the second tray from moving relative to the first tray.

Here, in the course of moving the second tray to the first position or the second position, when the second tray is located in the third position, the moving portion is not located at the locking position. Hence, when the second tray is moved to the first position or the second position, it is possible to prevent the second tray from being mistakenly locked in the third position.

With the feed tray according to the present teaching, by moving the second tray to the third position after moving the moving member to the first set position, it is possible to lock the second tray in the third position, whereas by moving the second tray to the first position or the second position after moving the moving member to the second set position, it is possible to lock the second tray in the first position or in the second position. That is, it is possible to lock the feed tray to stop the feed tray from lengthening and shortening in a position according to a desired sheet size.

DESCRIPTION OF THE PREFERRED EMBODIMENT

Figure 1:
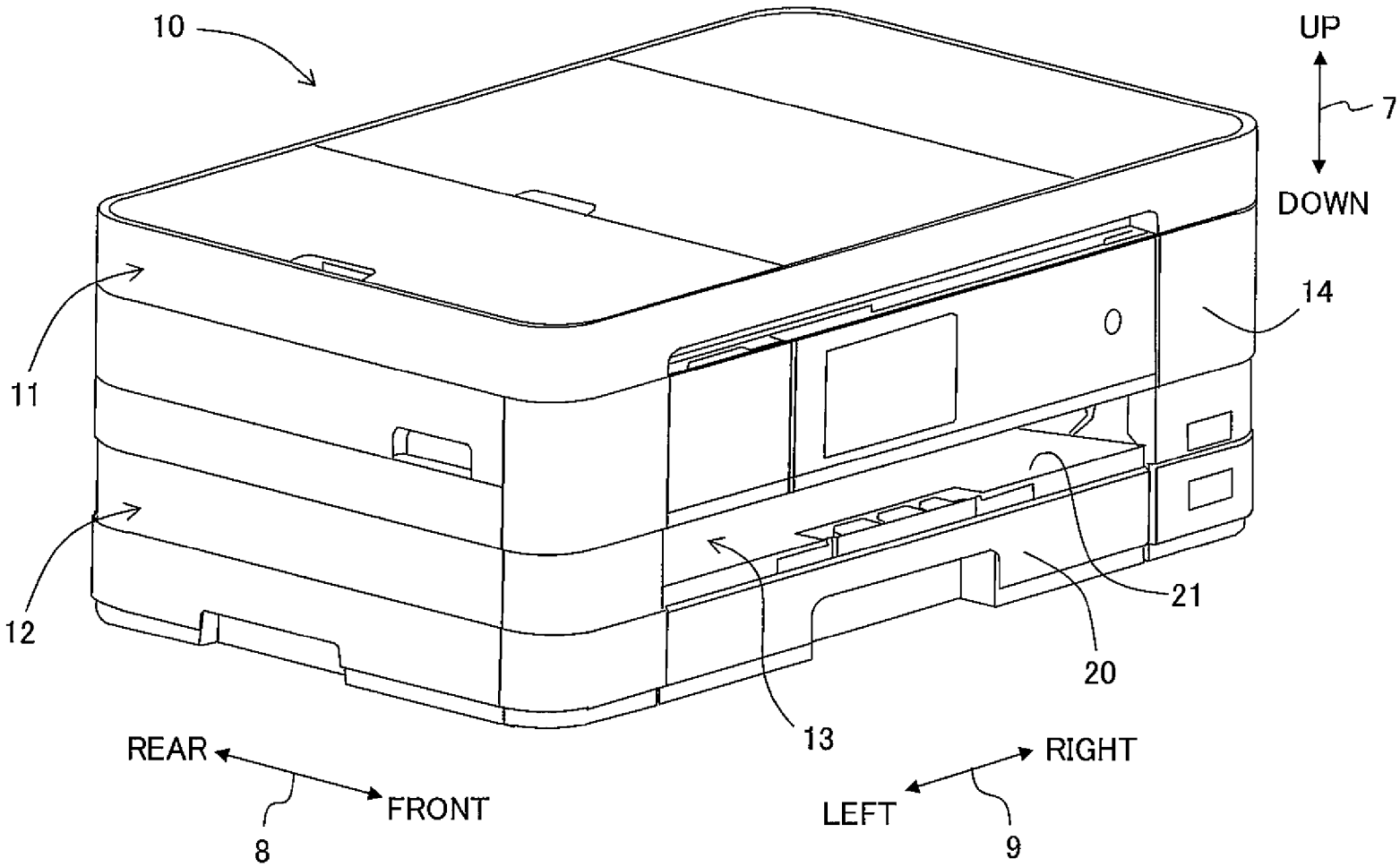
FIG. 1 is a perspective view of a multifunction printer 10.

Hereinbelow, a preferred embodiment of the present teaching will be explained. Further, it is needless to say that the embodiment explained below is an example of the present teaching, and thus it is possible to modify the embodiment of the present teaching as appropriate without departing from the true spirit and scope of the present teaching. Further, in the following explanation, an up-down direction 7 is defined with reference to such a state (the state depicted in FIG. 1) that a multifunction printer 10 is placed to be operable, a front-rear direction 8 is defined with an opening 13 provided at the near side (the front side), and a left-right direction 9 is defined as the multifunction printer 10 is viewed from the near side (the front side).

An Overall Configuration of the Multifunction Printer 10

As depicted in FIG. 1, the shape of the multifunction printer 10 is approximately cuboid. The multifunction printer 10 includes a scanner portion 11 which is located at an upper portion thereof and is configured to acquire image data by an image sensor for reading images recorded on a manuscript or an original document such as recording sheet. Further, the multifunction printer 10 includes a printer portion 12 which is located at a lower portion thereof and is configured to record the images on the recording sheet 15 (an example of the sheet of the present teaching) based on image data such as the acquired image data described above.

While the scanner portion 11 is configured as a so-called flatbed scanner, hereinbelow, however, any detailed explanation of internal configuration of the scanner portion 11 will be omitted. The shape of the printer portion 12 is also approximately cuboid, and has a case 14 with the opening 13 formed at the front side.

Figure 2:
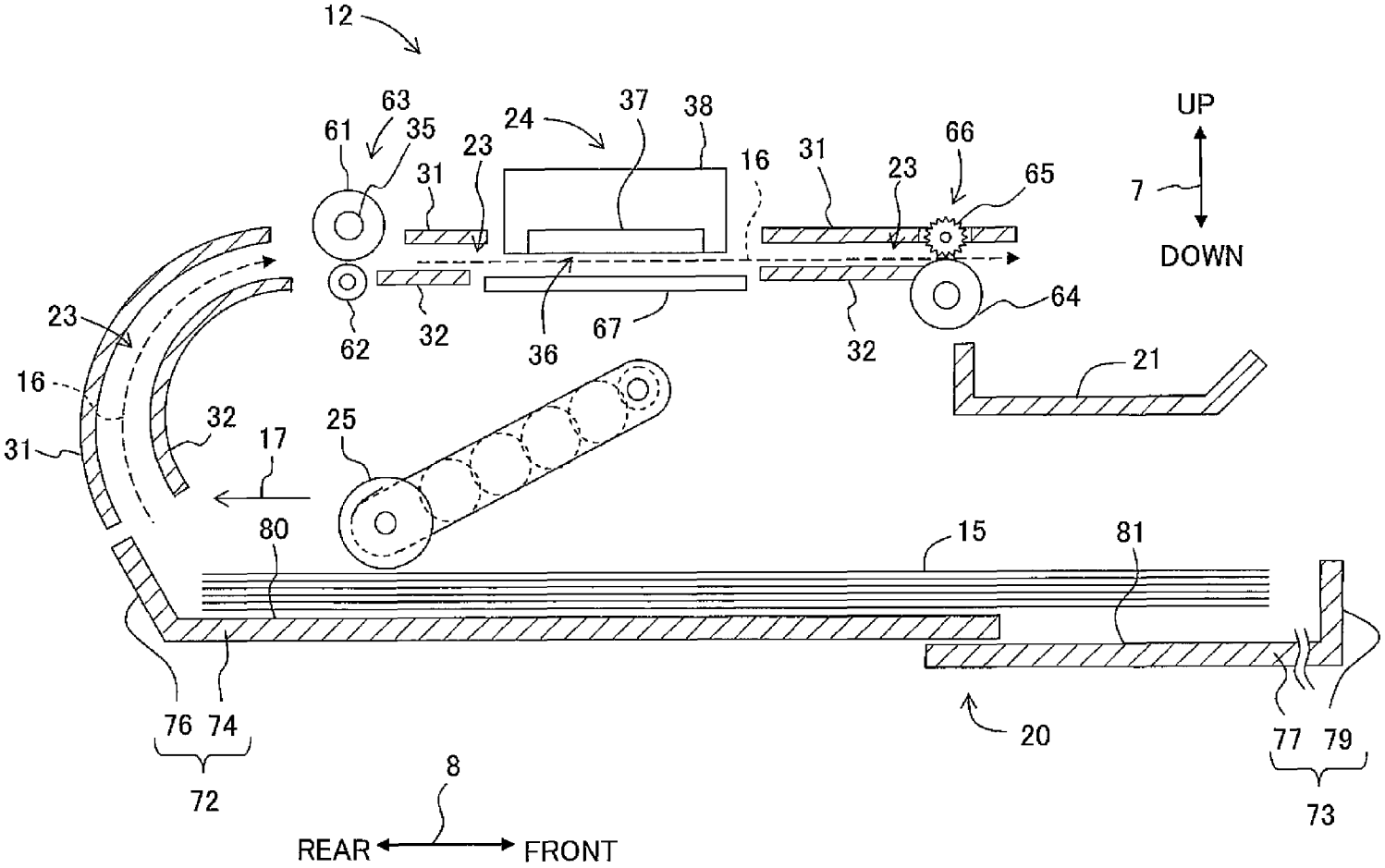
FIG. 2 is a longitudinal cross-sectional view schematically depicting an internal structure of a printer portion 12.

As depicted in FIG. 2, inside the case 14 of the printer portion 12, there are provided a feed tray 20 which is insertable to and removable from the opening 13 in the front-rear direction 8 and in which the recording sheet 15 is loaded, a discharge tray 21 provided above the feed tray 20, a feed roller 25 configured to feed the recording sheet 15 loaded in the feed tray 20 toward a conveyance path 23 in a feeding direction 17 (rearward), a conveyance roller pair 63 and a discharge roller pair 66 configured to convey the recording sheet 15 fed by the feed roller 25 along the conveyance path 23, a recording portion 24 configured to record images on the recording sheet 15 conveyed through the conveyance path 23 based on the image data read by the scanner portion 11 from the manuscript, and the like.

The recording sheet 15 with images recorded thereon is discharged to the discharge tray 21 and supported by the discharge tray 21. The discharge tray 21 is provided above the feed tray 20 to superimpose the feed tray 20, and is insertable to and removable from the opening 13 integrally with the feed tray 20 as a unit.

The Conveyance Path 23

As depicted in FIG. 2, the conveyance path 23 is such a pathway that with the rear end of the feed tray 20 as its starting point, it extends upward from below and then makes a U-turn and extends frontward up to the discharge tray 21. The conveyance path 23 is a space defined by a first guide member 31 and a second guide member 32 which face each other at a predetermined interval. The recording sheet 15 is fed from the feed tray 20 into the conveyance path 23, and then conveyed through the conveyance path 23 in a conveyance direction 16 depicted by the dashed arrows in FIG. 2. That is, the recording sheet 15 is conveyed frontward to be discharged to the discharge tray 21 after it is conveyed to move upward from below and make the U-turn.

The Conveyance Roller Pair 63 and the Discharge Roller Pair 66

As depicted in FIG. 2, the conveyance roller pair 63 including a conveyance roller 61 and a pinch roller 62 is provided on the upstream side to the recording portion 24 in the conveyance direction 16. The pinch roller 62 is pressed against the roller surface of the conveyance roller 61 by an elastic member (not depicted) such as a spring. The discharge roller pair 66 including a discharge roller 64 and a spur 65 is provided on the downstream side from the recording portion 24 in the conveyance direction 16. The spur 65 is pressed against the roller surface of the discharge roller 64 by another elastic member (not depicted) such as a spring. The conveyance roller 61 and the discharge roller 64 are rotated by a driving force transmitted from a conveyance motor (not depicted) to convey the recording sheet 15 nipped between the conveyance roller 61 and the pinch roller 62 and/or between the discharge roller 64 and the spur 65 in the conveyance direction 16.

The Recording Portion 24

As depicted in FIG. 2, the recording portion 24 is arranged above the conveyance path 23. The recording portion 24 includes a recording head 37 provided in such a position as able to face the conveyance path 23, and a carriage 38 on which the recording head 37 is mounted. In the recording head 37, a plurality of nozzles 36 are formed for ejecting ink supplied from an ink cartridge (not depicted) toward the conveyance path 23. The carriage 38 is configured to be movable reciprocatingly in the left-right direction 9. While the carriage 38 is moving reciprocatingly in the left-right direction 9, ink droplets are ejected from the nozzles 36 toward the recording sheet 15 conveyed along the conveyance path 23. By virtue of this, images are recorded on the recording sheet 15.

Further, in this embodiment, the recording portion 24 records images on the recording sheet 15 by an ink jet recording method. However, the recording method for the recording portion 24 to record images on the recording sheet 15 is not limited to the ink jet recording method, but may also be, for example, an electrophotographic method or the like. The platen 67 is arranged to face the lower surface of the recording head 37, and the platen 67 supports the recording sheet 15 conveyed through the conveyance path 23.

The Feed Tray 20

Figure 3B:
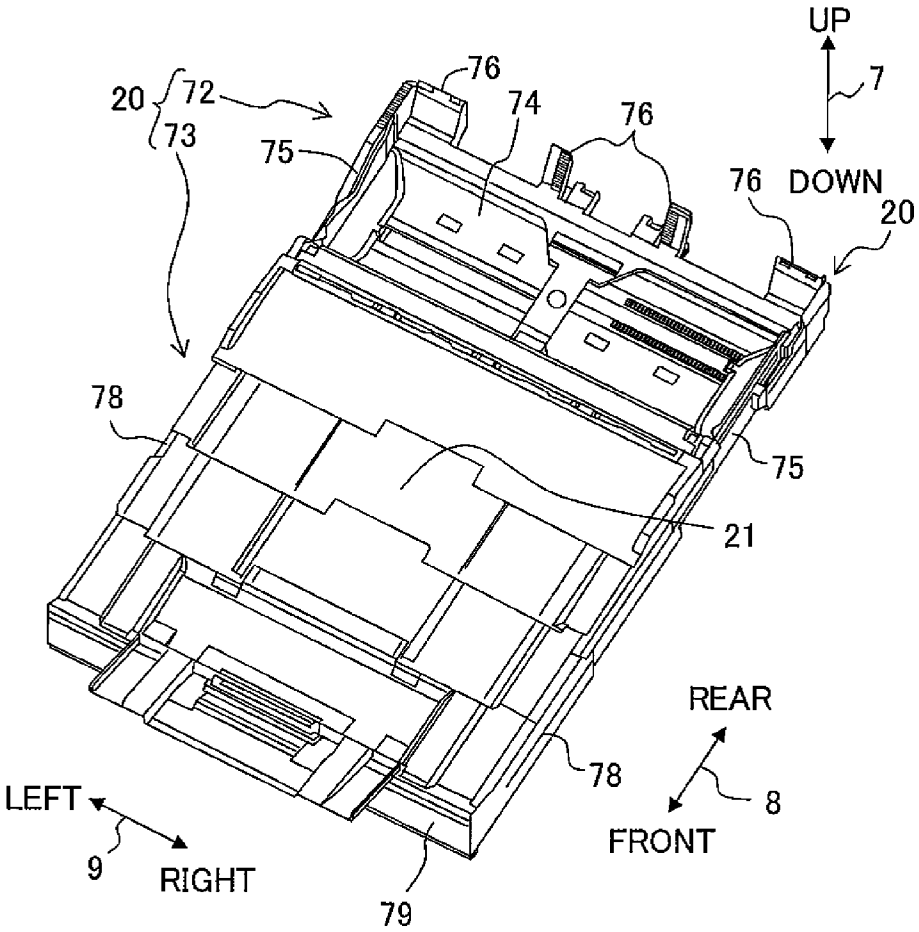
FIGS. 3A and 3B are perspective views of a feed tray 20 in support of a discharge tray 21.
Figure 3A:
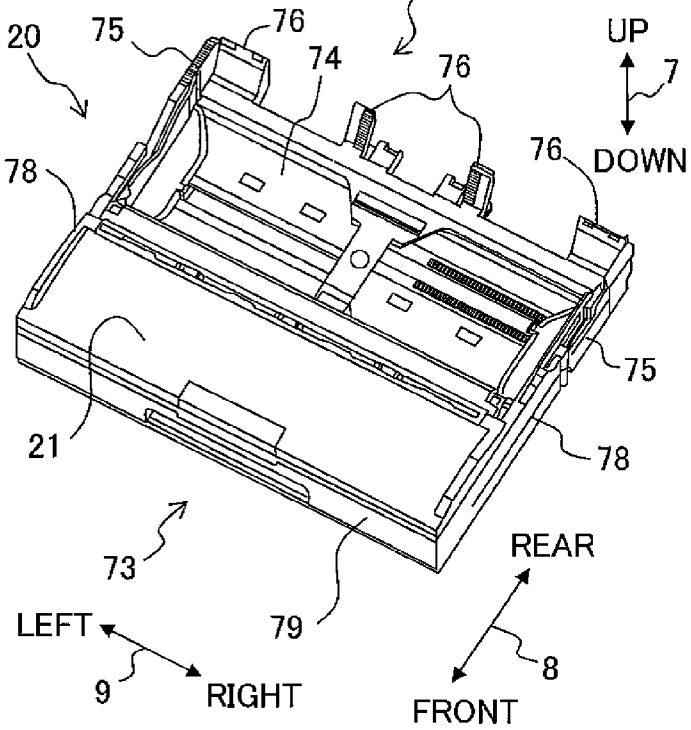
Figure 4:
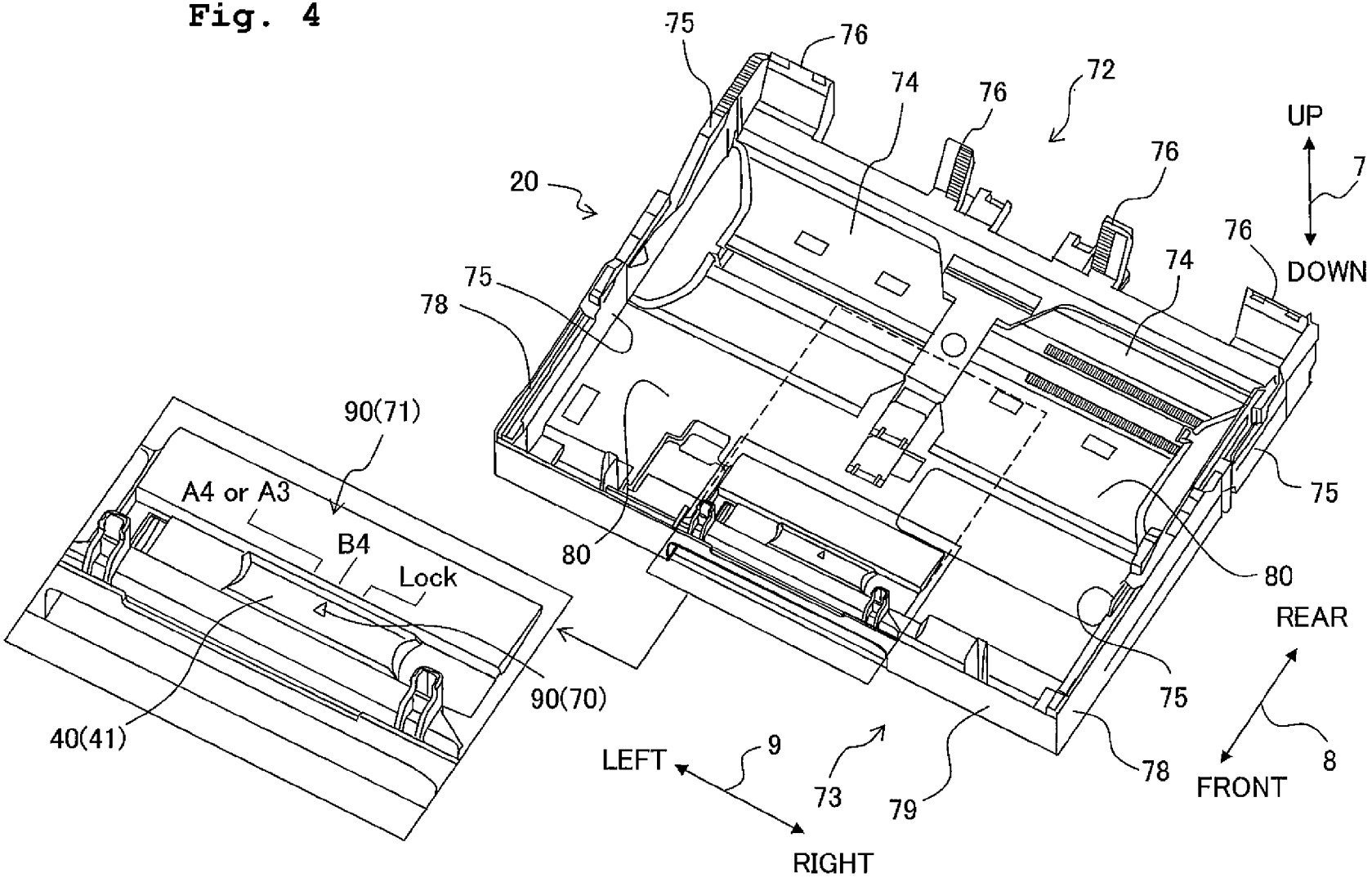
FIG. 4 is a perspective view of the feed tray 20.

As depicted in FIGS. 3A and 3B and FIG. 4, the feed tray 20 includes a first tray 72, a second tray 73 movable in the front-rear direction 8 relative to the first tray 72, and a lock mechanism 40 capable of locking the movement of the second tray 73 relative to the first tray 72 in the front-rear direction 8. The first tray 72 includes a bottom plate 74, a pair of lateral plates 75 provided to stand upward from the left and right ends of the bottom plate 74, and projections 76 provided to stand upward from the rear end of the bottom plate 74. An upper surface 80 of the bottom plate 74 (an example of the first support surface of the present teaching) supports stacked sheets of the recording sheet 15 to be fed into the conveyance path 23 inside the multifunction printer 10.

The second tray 73 is arranged to be overlapped with the first tray 72 from above. The second tray 73 includes a bottom plate 77 (see FIG. 2), a pair of lateral plates 78 provided to stand upward from the left and right ends of the bottom plate 77, and a front plate 79 provided to stand upward from the front end of the bottom plate 77. An upper surface 81 of this bottom plate 77 (see FIG. 2; an example of the second support surface of the present teaching) supports the stacked sheets of the recording sheet 15 to be fed into the conveyance path 23 inside the multifunction printer 10. Further, in FIG. 3B, the bottom plate 77 is hidden by the discharge tray 21. Further, contrary to the above description, the first tray 72 may otherwise be arranged to be overlapped with the second tray 73 from above.

The pair of lateral plates 78 of the second tray 73 are adjacent to the outer sides of the pair of lateral plates 75 of the first tray 72 according to the left-right direction 9, respectively. Further, the pair of lateral plates 78 of the second tray 73 are each provided with an engagement portion (not depicted) to engage with the upper ends of the pair of lateral plates 75 of the first tray 72, respectively. By virtue of this, the second tray 73 is movable in the front-rear direction 8 (an example of the moving direction of the present teaching) along the feeding direction 17 of the recording sheet 15, but is deterred from moving in the left-right direction 9. As a result, the second tray 73 slides relative to the first tray 72 in the front-rear direction 8.

When the second tray 73 is pushed in under the first tray 72 (see FIG. 3A), the recording sheet 15 to be fed into the conveyance path 23 is supported by the upper surface 80 of the bottom plate 74 of the first tray 72. That is, at this time, the respective upper surfaces 80 and 81 of the first tray 72 and the second tray 73 are superimposed or overlapped in a planar view, while the recording sheet 15 to be fed into the conveyance path 23 is loaded in the first tray 72 with its most part being supported by the upper surface 80 of the bottom plate 74 of the first tray 72. The position of the second tray 73 at this time is the first position of the present teaching. When the second tray 73 is situated in the first position, the recording sheet 15 of A4 size is supportable in the feed tray 20.

On the other hand, when the second tray 73 is pulled out from under the first tray 72 (see FIG. 2 and FIG. 3B), in planar view from above, although a front end portion of the upper surface 80 of the bottom plate 74 of the first tray 72 overlaps with a rear end portion of the upper surface 81 of the bottom plate 77 of the second tray 73, the other portions do not overlap with each other. That is, in planar view from above, the present overlapped area between the two upper surfaces 80 and 81 is smaller than when the second tray 73 is located at the first position. The recording sheet 15 to be fed into conveyance path 23 is supported by the most part of the upper surface 80 of the bottom plate 74 of the first tray 72, and by the most part of the upper surface 81 of the bottom plate 77 of the second tray 73 except the rear end portion. That is, at this time, the recording sheet 15 to be fed into the conveyance path 23 is loaded in the two trays 72 and 73 in such a state as is supported by the upper surfaces 80 and 81 of the two trays 72 and 73. The position of the second tray 73 at this time is the second position of the present teaching. When the second tray 73 is located at the second position, the recording sheet 15 of A3 size can be supported in the feed tray 20.

Further, when the second tray 73 is located at a third position between the first position and the second position, in planar view from above, the overlapped area between the bottom plate 74 of the first tray 72 and the bottom plate 77 of the second tray 73 is smaller than when the second tray 73 is located at the first position but larger than when the second tray 73 is located at the second position. In this embodiment, when the second tray 73 is located at the third position, the recording sheet 15 of B4 size can be supported in the feed tray 20. In the above manner, the second tray 73 is movable between the first position, the second position and the third position.

The Lock Mechanism 40

As will be described below in detail, the lock mechanism 40 is configured to be capable of locking the movement of the second tray 73 along the front-rear direction 8, that is, locking the second tray 73 to stop the same from moving between the first position and the second position, and to be capable of releasing the locking.

Figure 7A:
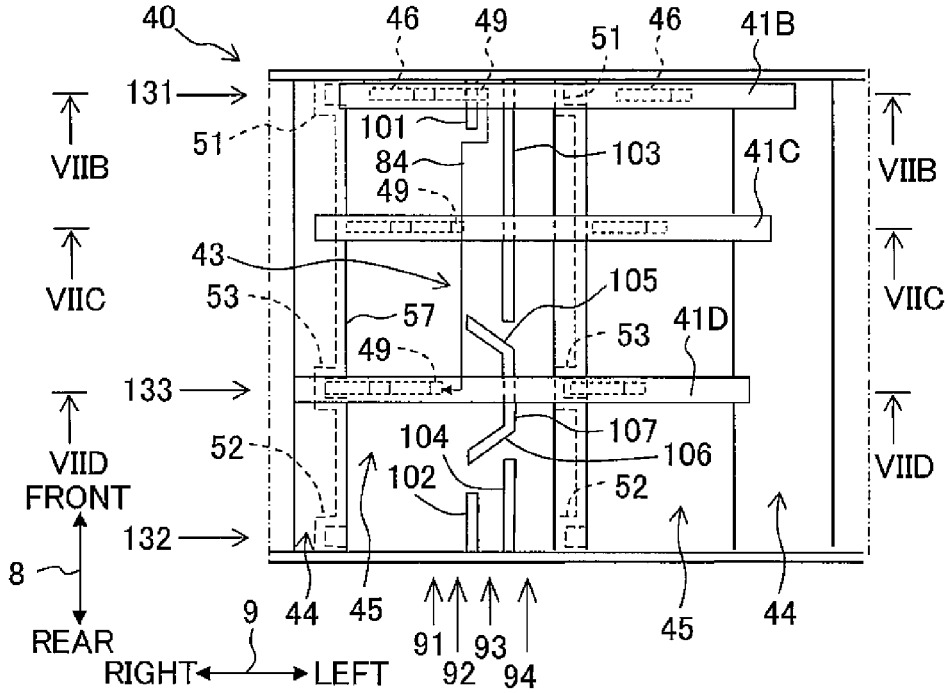
FIG. 7A is a plan view schematically depicting a lock mechanism 40.
Figure 7B:
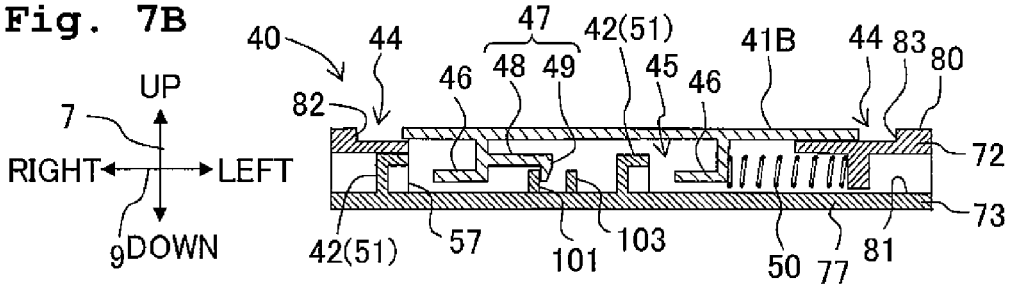
FIG. 7B is a cross-sectional view along the line VIIB-VIIB of FIG. 7A.
Figure 7C:
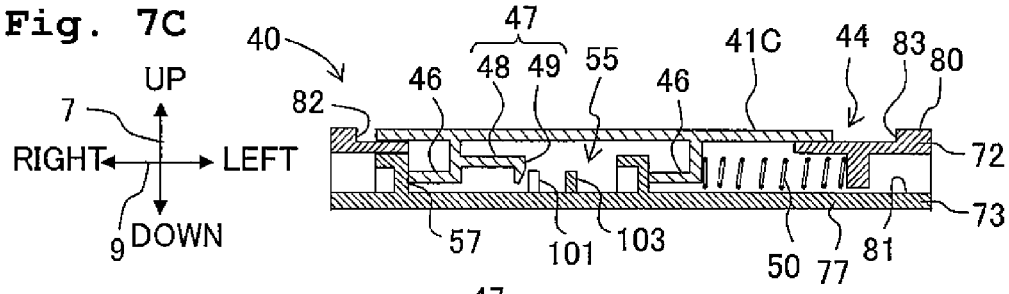
FIG. 7C is a cross-sectional view along the line VIIC-VIIC of FIG. 7A.
Figure 7D:
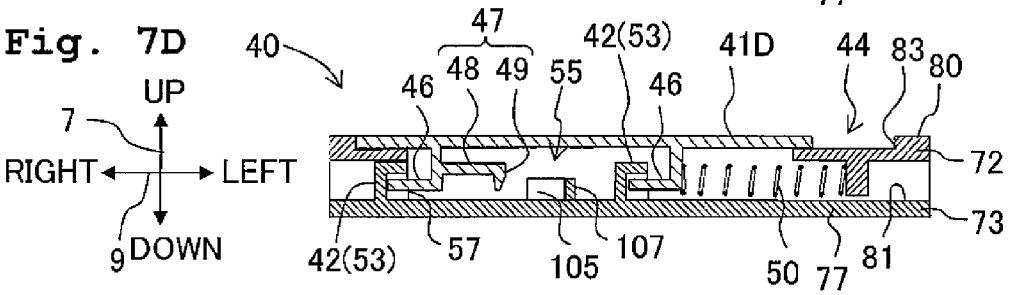
FIG. 7D is a cross-sectional view along the line VIID-VIID of FIG. 7A.

The lock mechanism 40 includes a moving member 41 (see FIG. 4), engaging-target portions 42 (see FIG. 7A), a guide portion 43 (see FIG. 7A and FIG. 11) and a biasing member 50 (see FIGS. 7B to 7D). Here, the lock mechanism 40 is provided within the area indicated by the dashed line in FIG. 4. While only the moving member 41 is exposed in FIG. 4, the engaging-target portions 42, the guide portion 43 and the biasing member 50 are hidden by the first tray 72. Further, the engaging-target portions 42, the guide portion 43 and the biasing member 50 are arranged below the first tray 72 at the side of the upper surface 81 of the bottom plate 77 of the second tray 73 overlapped with the first tray 72. The engaging-target portions 42, the guide portion 43 and the biasing member 50 are depicted in FIGS. 7A to 7D and FIG. 11. Further, as will be described later, the guide portion 43 includes a first guide portion 54 and a second guide portion 55 (see FIGS. 7A to 7D, FIGS. 8A to 8D and FIG. 11). Further, the engaging-target portions 42 include aftermentioned first engaging-target portions 51, second engaging-target portions 52 and third engaging-target portions 53.

The moving member 41 is supported by the upper surface 80 of the bottom plate 74 of the first tray 72 to be movable in the left-right direction 9 which is orthogonal to the front-rear direction 8 and along the upper surface 80 of the bottom plate 74 of the first tray 72. Further, the left-right direction 9 is an example of the intersectant direction of the present teaching. As will be described later, the engaging-target portions 42 are ribs projecting upward from the upper surface 81 of the bottom plate 77 of the second tray 73 and, at their left lateral sides, recesses are formed as large as can be inserted thereinto by the fore-ends of engaging portions 46. By letting the moving member 41 engage with these recesses, the second tray 73 is locked and stopped from moving relative to the first tray 72 in the front-rear direction 8. The guide portion 43 is provided on the second tray 73 to contact with the moving member 41 in the course of the second tray 73 moving in the front-rear direction 8 so as to guide the moving member 41 in the left-right direction 9. The biasing member 50 is provided to bias the moving member 41 rightward. Detailed explanations will be made later on the moving member 41, the engaging-target portions 42, the guide portion 43 and the biasing member 50.

The Moving Member 41

Figure 6A:
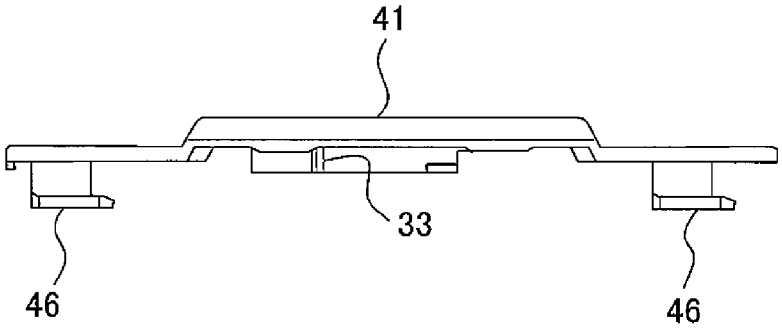
FIGS. 6A to 6C are perspective views of a moving member 41.
Figure 6B:
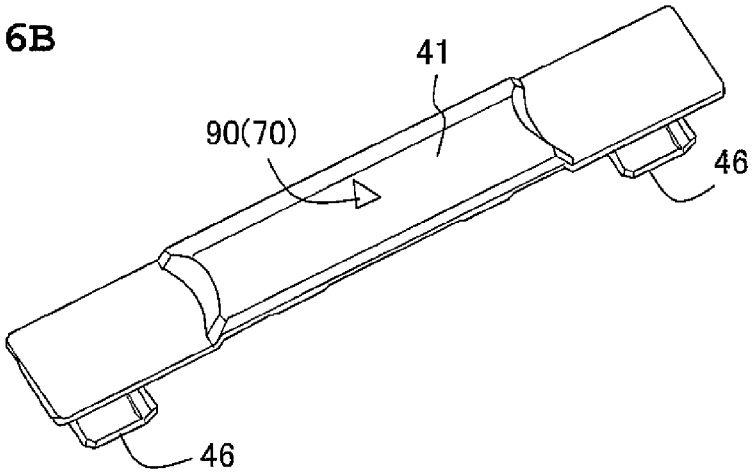
Figure 6C:
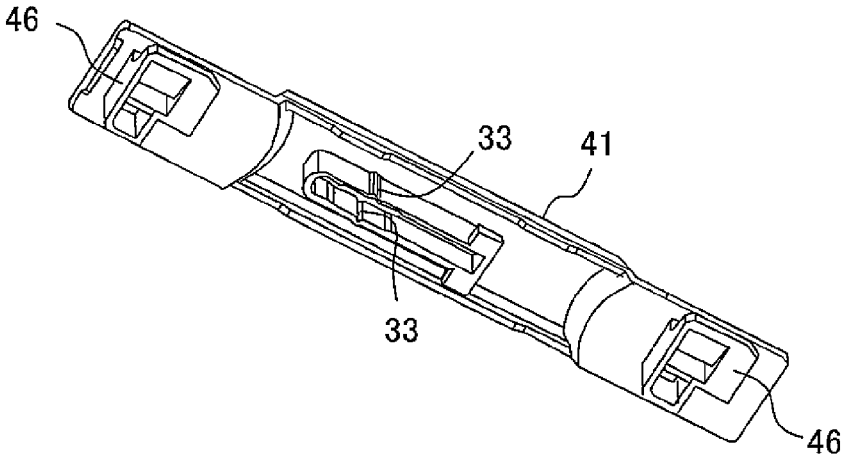

As depicted in FIGS. 6A to 6C, the moving member 41 is a slender plate-like member formed of resin. As depicted in FIG. 4 and FIGS. 7A to 7D, the moving member 41 is a plate-like member and is arranged so that the width-direction, the longitudinal direction and the height-direction thereof are parallel to the front-rear direction 8, the left-right direction 9 and the up-down direction 7, respectively. Further, the moving member 41 is supported by the upper surface 80 of the bottom plate 74 of the first tray 72 to be movable in the left-right direction 9.

A recess 44 is formed in a front end portion, as well as a central portion according to the left-right direction 9, of the upper surface 80 of the bottom plate 74 of the first tray 72. An opening 45 is formed in a central portion of the recess 44 according to the left-right direction 9. End portions of the moving member 41 on the left and right are supported on by end portions of the recess 44 according to the left-right direction 9.

The moving member 41 is shorter than the recess 44 in the left-right direction 9. Thereby, the moving member 41 is movable relative to the first tray 72 in the left-right direction 9 within the range between a right contact position (the position depicted in FIG. 7D) and a left contact position (the position depicted in FIG. 8B). Here, the right contact position is such a position as for the right end of the moving member 41 to contact with a right lateral surface 82 of the recess 44. The left contact position is such a position as for the left end of the moving member 41 to contact with a left lateral surface 83 of the recess 44. The moving member 41 is approximately as long as the recess 44 in the front-rear direction 8. Thereby, the moving member 41 does not move relative to the first tray 72 in the front-rear direction 8. In the above manner, the moving member 41 and the first tray 72 are movable relative to each other in the left-right direction 9 but not movable relative to each other in the front-rear direction 8.

As depicted in FIGS. 6A to 6C and FIGS. 7A to 7D, the moving member 41 includes the engaging portions 46, a projection 47 and an indicative portion 90. Further, illustration of the projection 47 is omitted in FIGS. 6A to 6C.

The engaging portions 46 are protrusions protruding in an L-shape respectively from a left end portion and a right end portion of the lower surface of the moving member 41. The engaging portions 46 are configured to engage with the engaging-target portions 42 when the moving member 41 is located at the right contact position, and are configured to separate from the engaging-target portions 42 when the moving member 41 is located at the left contact position. As depicted in FIG. 7D, etc., with the engaging portions 46 engaging with the engaging-target portions 42, the first tray 72 and the second tray 73 are linked or connected via the moving member 41. By virtue of this, the second tray 73 is locked and stopped from moving relative to the first tray 72 in the front-rear direction 8. On the other hand, with the engaging portions 46 separated from the engaging-target portions 42, because the first tray 72 and the second tray 73 are delinked or disconnected, the second tray 73 is movable relative to the first tray 72 in the front-rear direction 8.

The projection 47 includes an extension portion 48 extending from the (right) engaging portion 46 along the left-right direction 9, and a flexed portion 49 (also referred to as "a bendable portion 49", an example of the moving portion of the present teaching) flexed downward at the fore-end portion of the extension portion 48. The extension portion 48 is positioned above the guide portion 43 (see FIG. 11). The flexed portion 49 extends below the upper end of the guide portion 43. That is, the flexed portion 49 extends from the first tray 72 toward the second tray 73. By virtue of this, the flexed portion 49 is contactable with the guide portion 43.

The extension portion 48 is connected with the engaging portion 46 at the base end side but not connected with any member at the fore-end side. Further, as described above, the moving member 41 including the extension portion 48 is formed of resin. By virtue of this, the extension portion 48 is adapted to bend with its base end as the axis to let the fore-end move approximately in the up-down direction 7. That is, the extension portion 48 is movable due to elasticity in such an orientation as away from the second tray 73.

As depicted in FIGS. 7A to 7D and FIGS. 8A to 8D, because the moving member 41 moves in the left-right direction 9, the flexed portion 49 moves along the left-right direction 9 to a locking position 91, an unlocking position 92, a first set position 93 and a second set position 94. Here, the locking position 91, the unlocking position 92, the first set position 93 and the second set position 94 are positions in the left-right direction 9.

The locking position 91 is the rightmost position among the four positions. When the flexed portion 49 is situated at the locking position 91, the moving member 41 is located at the right contact position. By virtue of this, the engaging portions 46 are engageable with the engaging-target portions 42. The unlocking position 92 is a position at the left side of the locking position 91. When the flexed portion 49 is located at the unlocking position 92, the engaging portions 46 are separate from the engaging-target portions 42, and thus not engageable with the engaging-target portions 42.

The first set position 93 is a position at the left side of the unlocking position 92. The flexed portion 49 is set at the first set position 93 when the second tray 73 is moved to the third position between the first position and the second position. The second set position 94 is the leftmost position among the four positions. The flexed portion 49 is set at the second set position 94 when the second tray 73 is moved to the first position or the second position. When the flexed portion 49 is located at the second set position 94, the moving member 41 is located at the left contact position. Further, when the flexed portion 49 is located at the first set position 93 or at the second set position 94, the engaging portions 46 are separate from the engaging-target portions 42, and thus not engageable with the engaging-target portions 42.

In the front-rear direction 8, the flexed portion 49 of the projection 47 is located at a first guide position 131 of the guide portion 43 when the second tray 73 is located at the first position, located at a second guide position 132 of the guide portion 43 when the second tray 73 is located at the second position, and located at a third guide position 133 of the guide portion 43 when the second tray 73 is located at the third position. In other words, the flexed portion 49 of the projection 47 faces a portion of the upper surface 80 of the first tray 72 at the first guide position 131 when the second tray 73 is located at the first position, faces a portion of the upper surface 80 of the first tray 72 at the second guide position 132 when the second tray 73 is located at the second position, and faces a portion of the upper surface 80 of the first tray 72 at the third guide position 133 when the second tray 73 is located at the third position.

As depicted in FIG. 4, the indicative portion 90 includes a first designation portion 70 exhibited by paint or the like on the upper surface of the moving member 41, and second designation portions 71 exhibited by paint or the like on the upper surface 80 of the bottom plate 74 of the first tray 72.

The first designation portion 70 has a triangular shape with its apex pointed rearward. The second designation portions 71 are provided on the upper surface 80 at the rear side of the moving member 41. The second designation portions 71 are provided in such positions as to coordinate with the first designation portion 70 in the front-rear direction 8. The number of the second designation portions 71 is three which are provided at intervals in the left-right direction 9. By moving the moving member 41 in the left-right direction 9, the first designation portion 70 comes to coordinate with one of the second designation portions 71.

The three second designation portions 71 are exhibited as "Lock", "B4" and "A4 or A3" in order from right. The second designation portion 71 exhibited as "Lock" is provided in such a position as to coordinate with the first designation portion 70 when the flexed portion 49 is located at the locking position 91. By virtue of this, the second tray 73 is locked relative to the first tray 72 when the moving member 41 is moved to the position where the first designation portion 70 coordinates with the second designation portion 71 exhibited as "Lock".

The second designation portion 71 exhibited as "B4" is provided in such a position as to coordinate with the first designation portion 70 when the flexed portion 49 is located at the first set position 93. By virtue of this, if a user desires to load the recording sheet 15 of B4 size into the feed tray 20, in other words, if the user desires to move the second tray 73 to the third position, then the user only needs to let the first designation portion 70 coordinate with the second designation portion 71 exhibited as "B4".

The second designation portion 71 exhibited as "A4 or A3" is provided in such a position as to coordinate with the first designation portion 70 when the flexed portion 49 is located at the second set position 94. By virtue of this, if the user of the multifunction printer 10 desires to load the recording sheet 15 of A4 or A3 size into the feed tray 20, in other words, if the user desires to move the second tray 73 to the first position or to the second position, then the user only needs to let the first designation portion 70 coordinate with the second designation portion 71 exhibited as "A4 or A3".

Figure 5:
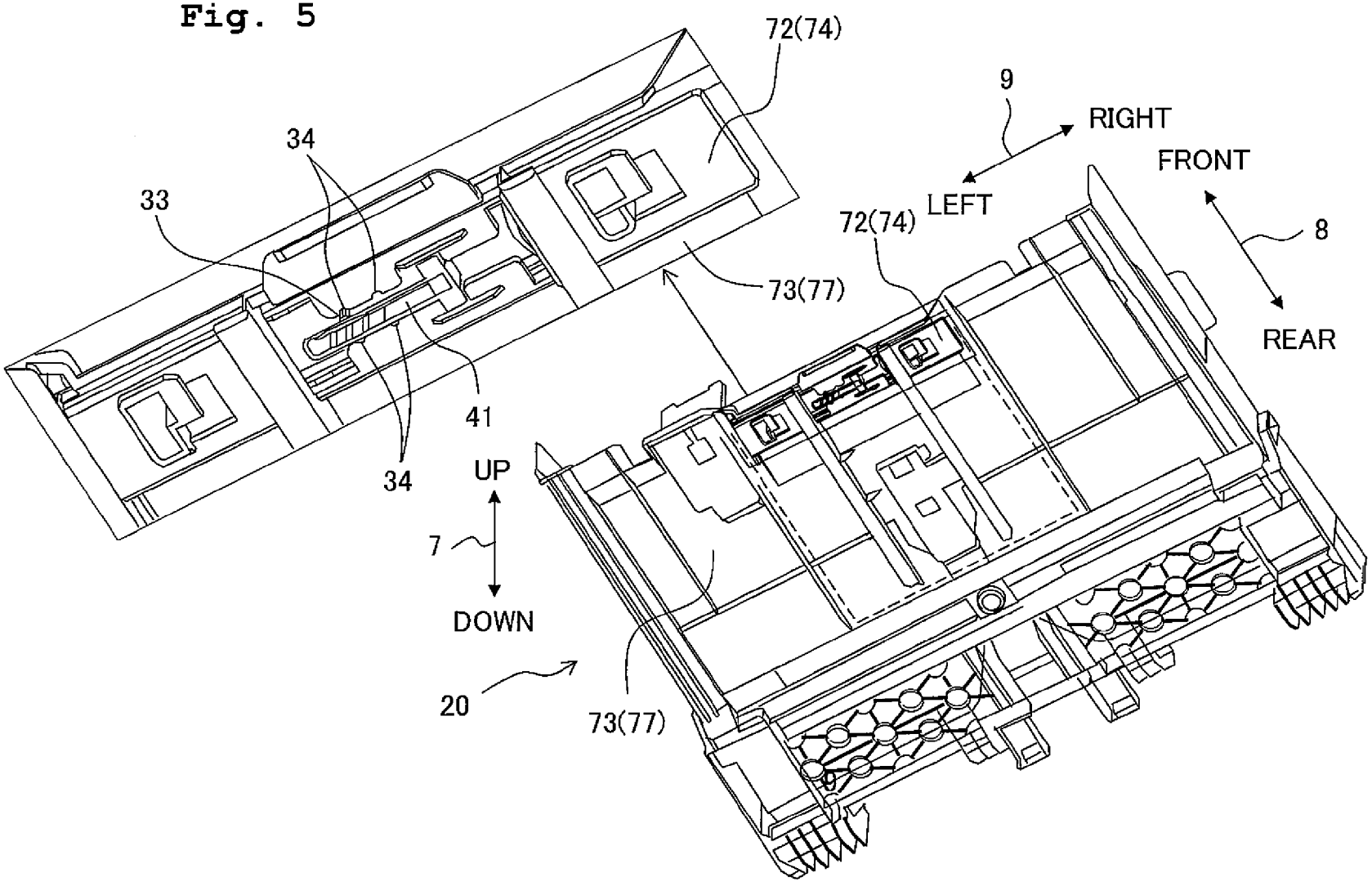
FIG. 5 is a perspective view of the feed tray 20 seen from diagonally below.

Further, in this embodiment, it is possible for the moving member 41 to stop at each predetermined interval in the course of movement. Here, the moving member 41 stops at each predetermined interval in such a position as with flexed portion 49 located at the locking position 91, the unlocking position 92, the first set position 93 or the second set position 94. In this manner, the moving member 41 is configured as follows to stop at each predetermined interval. As depicted in FIG. 5 and FIGS. 6A to 6C, the moving member 41 includes a projection 33 on its lower end. Further, as depicted in FIG. 5, the first tray 72 includes a plurality of recesses 34 in such positions as able to face the projection 33. By virtue of this, in the course of moving the moving member 41, the projection 33 undergoes elastic deformation in positions not facing the recesses 34. Therefore, the moving member 41 moves continuously but stops in each position where the projection 33 faces any of the recesses 34 because the projection 33 is fitted into that recess 34. Under this condition, if the user applies a force to move the moving member 41, then the projection 33 is separated from that recess 34 and subjected to elastic deformation, thereby enabling the moving member 41 to move continuously.

The Engaging-Target Portions 42

As depicted in FIGS. 7A to 7D and FIGS. 8A to 8D, the engaging-target portions 42 are provided on the upper surface 81 of the bottom plate 77 of the second tray 73. The engaging-target portions 42 include the first engaging-target portions 51, the second engaging-target portions 52 and the third engaging-target portions 53. The respective engaging-target portions 51 to 53 include ribs having a protrusive shape projecting upward from the upper surface 81 and, at the left lateral side of this protrusive shape, a recess is formed as large as can be inserted thereinto by the fore-end of the corresponding engaging portion 46. That is, the recesses of the engaging-target portions 51 to 53 are formed to open leftward and to be a little larger than the engaging portions 46, respectively. The recesses are formed with walls on the right side in the front-rear direction 8 so as to restrict the moving member 41 from moving in the front-rear direction 8 and from moving in a rightward orientation if the engaging portions 46 are inserted thereinto. Further, the respective engaging-target portions 51 to 53 are not limited to the shape as described above. For example, the respective engaging-target portions 51 to 53 may be ribs standing on the upper surface 81, the ribs being U-shaped in planar view. Then, the respective engaging-target portions 51 to 53 may be configured such that the engaging portions 46 may be inserted into the U-shaped recesses.

As depicted in FIG. 7A, the respective engaging-target portions 51 to 53 are provided apart from each other along the front-rear direction 8. The respective engaging-target portions 51 to 53 are located at the left-right direction 9 at the same positions as the fore-ends of the engaging portions 46 are located when the flexed portion 49 is located at the left-right direction 9 at the locking position 91. In other words, when the flexed portion 49 is located at the locking position 91, the fore-end of each of the engaging portions 46 has engaged with one of the respective engaging-target portions 51 to 53.

The first engaging-target portions 51 are located at the front-rear direction 8 at the same positions as the fore-ends of the engaging portions 46 are located at the front-rear direction 8 when the second tray 73 is located at the first position. That is, the first engaging-target portions 51 are provided at such positions as to engage with the engaging portions 46 when the second tray 73 is located at the first position and the flexed portion 49 is located at the locking position 91.

The second engaging-target portions 52 are located at the front-rear direction 8 at the same positions as the fore-ends of the engaging portions 46 are located at the front-rear direction 8 when the second tray 73 is located at the second position. That is, the second engaging-target portions 52 are provided at such positions as to engage with the engaging portions 46 when the second tray 73 is located at the second position and the flexed portion 49 is located at the locking position 91.

The third engaging-target portions 53 are located at the front-rear direction 8 at the same positions as the fore-ends of the engaging portions 46 are located at the front-rear direction 8 when the second tray 73 is located at the third position. That is, the third engaging-target portions 53 are provided at such positions as to engage with the engaging portions 46 when the second tray 73 is located at the third position and the flexed portion 49 is located at the locking position 91.

The Guide Portion 43

As depicted in FIGS. 7A to 7D, FIGS. 8A to 8D and FIG. 11, the guide portion 43 includes the first guide portion 54 and the second guide portion 55. The first guide portion 54 is configured to guide the flexed portion 49 at the first set position 93 to the locking position 91 in the course of the second tray 73 moving either from the first position to the third position or from the second position to the third position. The second guide portion 55 is configured to guide the flexed portion 49 at the second set position 94 to the locking position 91 in the course of the second tray 73 moving from the first position to the second position, from the second position to the first position, from the third position to the first position or from the third position to the second position. Here, the second tray 73 passes through the third position when moving between the first position and the second position in the front-rear direction 8. On this occasion, the second guide portion 55 guides the flexed portion 49 along such a guide path that the flexed portion 49 may not be located at the locking position 91 when the second tray 73 is located at the third position. That is, the second guide portion 55 does not guide the flexed portion 49 at the second set position 94 to the locking position 91 when the second tray 73 is located at the third position. However, the second guide portion 55 guides the flexed portion 49 to the locking position 91 when the second tray 73 has moved to the first position or second position.

As will be described later, each of the first guide portion 54 and the second guide portion 55 includes a plurality of ribs provided to stand on the upper surface 81 of the bottom plate 77 of the second tray 73.

Further, steps are formed in a peripheral portion 56 of the guide portion 43. The peripheral portion 56 is provided to prevent the projection 47 provided on the moving member 41 from going beyond the area where the guide portion 43 is provided. Within the peripheral portion 56, a right peripheral portion 57 (an example of the guide rib of the present teaching) provided on the right side extends in the front-rear direction 8 across the entire area of from the first guide position 131 to the third guide position 133 and from the second guide position 132 to the third guide position 133. In other words, the right peripheral portion 57 extends in the front-rear direction 8 across the range from the vicinity of the first guide position 131 at the rear side to the vicinity of the third guide position 133 at the front side, and across the range from the vicinity of the second guide position 132 at the front side to the vicinity of the third guide position 133 at the rear side.

The First Guide Portion 54

As depicted in FIGS. 7A to 7D, FIGS. 8A to 8D and FIG. 11, the first guide portion 54 includes a first rib 101 and a second rib 102. Each of the ribs 101 and 102 is higher than the fore-end of the flexed portion 49 of the projection 47 but lower than the lower surface of the extension portion 48 of the projection 47. The first rib 101 and the second rib 102 are linear ribs extending in a direction along the front-rear direction 8.

The first rib 101 is provided between the unlocking position 92 and the first set position 93 in the left-right direction 9, and extends from the first guide position 131 to a fourth guide position 134 in the front-rear direction 8. Here, the fourth guide position 134 is a position between the first guide position 131 and the third guide position 133 in the front-rear direction 8.

The second rib 102 is provided between the unlocking position 92 and the first set position 93 in the left-right direction 9, and extends from the second guide position 132 to a fifth guide position 135 in the front-rear direction 8. Here, the fifth guide position 135 is a position between the second guide position 132 and the third guide position 133 in the front-rear direction 8.

The Second Guide Portion 55

As depicted in FIGS. 7A to 7D, FIGS. 8A to 8D and FIG. 11, the second guide portion 55 includes a third rib 103, a fourth rib 104, a fifth rib 105 and a sixth rib 106. Further, the second guide portion 55 includes a seventh rib 107 (an example of the movement impediment portion of the present teaching) configured to impede or block the flexed portion 49 from moving rightward, that is, from moving toward the locking position 91 with the second tray 73 located at the third position. As with the ribs 101 and 102, each of the ribs 103 to 107 is higher than the fore-end of the flexed portion 49 of the projection 47 but lower than the lower surface of the extension portion 48 of the projection 47. The third rib 103 and the fourth rib 104 are linear ribs extending in a direction along the front-rear direction 8.

The third rib 103 is provided between the first set position 93 and the second set position 94 in the left-right direction 9, and extends from the first guide position 131 to a sixth guide position 136 in the front-rear direction 8. Here, the sixth guide position 136 is a position between the fourth guide position 134 and the third guide position 133 in the front-rear direction 8.

The fourth rib 104 is provided between the first set position 93 and the second set position 94 in the left-right direction 9, and extends from the second guide position 132 to a seventh guide position 137 in the front-rear direction 8. Here, the seventh guide position 137 is a position between the fifth guide position 135 and the third guide position 133 in the front-rear direction 8.

As depicted in FIG. 7A, the fifth rib 105, the sixth rib 106 and the seventh rib 107 are connected with each other. The seventh rib 107 is arranged between the first set position 93 and the second set position 94 in the left-right direction 9, and extends in the front-rear direction 8. Further, the end of the seventh rib 107 at the front side connects with the left end of the fifth rib 105 while the end of the seventh rib 107 at the rear side connects with the left end of the sixth rib 106.

The fifth rib 105 extends from the end of the seventh rib 107 at the front side to be inclined obliquely frontward and rightward. In other words, the end of the fifth rib 105 at the rear side is located between the first set position 93 and the second set position 94 in the left-right direction 9, and between the end of the third rib 103 at the rear side and the third guide position 133 in the front-rear direction 8. Further, the end of the fifth rib 105 at the front side is located between the unlocking position 92 and the first set position 93 in the left-right direction 9, and between the sixth guide position 136 and the fourth guide position 134 in the front-rear direction 8.

The sixth rib 106 extends from the end of the seventh rib at the rear side to be inclined obliquely rearward and rightward. In other words, the end of the sixth rib 106 at the front side is located between the first set position 93 and the second set position 94 in the left-right direction 9, and between the end of the fourth rib 104 at the front side and the third guide position 133 in the front-rear direction 8. Further, the end of the sixth rib 106 at the rear side is located between the unlocking position 92 and the first set position 93 in the left-right direction 9, and between the seventh guide position 137 and the fifth guide position 135 in the front-rear direction 8.

Further, the seventh rib 107 is not limited to the above configuration as long as it impedes or blocks the flexed portion 49 located at the left side of the seventh rib 107 from moving rightward. For example, the seventh rib 107 may extend in a direction intersecting the left-right direction 9. Further, the seventh rib 107 may connect with other parts of the fifth rib 105 and the sixth rib 106 than their left ends. Further, the seventh rib 107 need not connect with the fifth rib 105 and the sixth rib 106, provided that the seventh rib 107 is separated from the fifth rib 105 and the sixth rib 106 at an interval as narrow as not passable therethrough by the flexed portion 49.

The Biasing Member 50

As depicted in FIGS. 7A to 7D and FIGS. 8A to 8D, the biasing member 50 is a coil spring. One end of the coil spring is arranged on the moving member 41 while the other end of the coil spring is arranged on the first tray 72. For example, it is possible to fit the coil spring at its natural length with the moving member 41 located at the right contact position (the state depicted in FIG. 7D and FIG. 8D). By virtue of this, if the moving member 41 moves leftward from the right contact position, then the coil spring is compressed to exert a rightward biasing force on the moving member 41. As a result, the moving member 41 is biased rightward. Alternatively, the coil spring may be arranged to deviate from its natural length when the moving member 41 is located at the right contact position, so as to exert the rightward biasing force on the moving member 41. Further, the biasing member 50 is not limited to a coil spring as long as it biases the moving member 41 rightward but, for example, may be a plate spring.

Movement of the Second Tray 73 Relative to the First Tray 72

Referring to FIGS. 7A to 7D and FIG. 11, an explanation will be made below on the operation of each element constituting the feed tray 20 in the process of locking, in the third position, the second tray 73 locked by the lock mechanism 40 in the first position.

In the initial state, the second tray 73 is located at the first position. On this occasion, the moving member 41 is located above the first guide position 131 according to the front-rear direction 8. Further, the flexed portion 49 provided on the moving member 41 is located at the locking position 91 according to the left-right direction 9. Therefore, the fore-ends of the engaging portions 46 are inserted in the recesses provided at the lateral sides of the first engaging-target portions 51. By virtue of this, the second tray 73 is locked and stopped from moving relative to the first tray 72 in the front-rear direction 8.

In the above initial state, if the user of the multifunction printer 10 holds the moving member 41, or in a like manner, to move the same leftward, then the flexed portion 49 also moves leftward. In the course of moving leftward, the flexed portion 49 comes to contact with the first rib 101. At this time, because the user is applying a leftward force, the flexed portion 49 moves upward due to the elastic deformations of the extension portion 48 and the flexed portion 49 per se. By virtue of this, the flexed portion 49 passes over the first rib 101, and moves from the locking position 91 to the first set position 93 via the unlocking position 92. That is, the moving member 41 is located at the position indicated by the reference "41B" in FIG. 7A, that is, in the position depicted in FIG. 7B. By virtue of this, the engaging portions 46 are separated from the first engaging-target portions 51. As a result, the second tray 73 is unlocked and becomes movable relative to the first tray 72 in the front-rear direction 8. Further, because the moving member 41 is biased rightward by the biasing member 50, the flexed portion 49 located at the first set position 93 contacts with the left lateral side of the first rib 101.

Next, if the user moves the second tray 73 frontward, then, as will be described below in detail, the flexed portion 49 makes a relative movement along the guide portion 43 in an orientation indicated by the arrow 84 in FIG. 7A. Here, the relative movement of the flexed portion 49 along the guide portion 43 refers to a change in the position of contact between the flexed portion 49 and the guide portion 43 due to the movement of the flexed portion 49. The same is true in the following explanation.

First, the flexed portion 49 makes a rearward relative movement along the left lateral side of the first rib 101. On passing through the fourth guide position 134, the flexed portion 49 is caused to move rightward by the biasing force of the biasing member 50. The moving member 41 also moves rightward up to such a position that the fore-end of the (right) engaging portion 46 contacts with the right peripheral portion 57, so as to be located at the position indicated by the reference "41C" in FIG. 7A, that is, in the position depicted in FIG. 7C. That is, the flexed portion 49 moves from the first set position 93 to the unlocking position 92. At this time, the fore-end of the engaging portion 46 contacts with the right peripheral portion 57. Therefore, the flexed portion 49 is not allowed to move from the unlocking position 92 to the locking position 91.

In this state, if the second tray 73 is further moved frontward, then the fore-end of the engaging portion 46 makes a rearward relative movement along the left lateral side of the right peripheral portion 57. When the second tray 73 arrives in the third position, the biasing force of the biasing member 50 causes the engaging portion 46 to leave the right peripheral portion 57 and come into the recess provided at the lateral side of the third engaging-target portion 53. By virtue of this, the moving member 41 also moves rightward so as to be located at the position indicated by the reference "41D" in FIG. 7A, that is, in the position depicted in FIG. 7D. That is, the flexed portion 49 moves from the unlocking position 92 to the locking position 91. As a result, the second tray 73 is locked in the third position and stopped from moving relative to the first tray 72 in the front-rear direction 8.

Further, in the process of locking, in the third position, the second tray 73 locked by the lock mechanism 40 in the second position, the operation of each element constituting the feed tray 20 is almost the same as the operation mentioned above except that: (i) the second tray 73 moves rearward; (ii) the flexed portion 49 makes a relative movement while contacting with the second rib 102; and (iii) the engaging portion 46 makes a relative movement while contacting with the right peripheral portion 57 between the second guide position 132 and the third guide position 133. Hence, any detailed explanation on that operation will be omitted herein.

Next, referring to FIGS. 8A to 8D and FIG. 11, an explanation will be made on the operation of each element constituting the feed tray 20 in the process of locking, in the second position, the second tray 73 locked by the lock mechanism 40 in the first position.

The initial state is the same as the case of FIGS. 7A to 7D.

In this initial state, if the user of the multifunction printer 10 moves the moving member 41 leftward, then the flexed portion 49 also moves leftward. In the course of moving leftward, the flexed portion 49 comes to contact with the first rib 101 and the third rib 103. However, because the flexed portion 49 of the projection 47 moves upward, as described earlier, due to the elastic deformations of the extension portion 48 and the flexed portion 49 per se, the flexed portion 49 passes over the first rib 101 and the third rib 103, and moves from the locking position 91 to the second set position 94. That is, the moving member 41 is located at the position indicated by the reference "41B" in FIG. 8A, that is, in the position depicted in FIG. 8B. By virtue of this, the engaging portions 46 are separated from the first engaging-target portions 51. As a result, the second tray 73 is unlocked and becomes movable relative to the first tray 72 in the front-rear direction 8. Further, because the moving member 41 is biased rightward by the biasing member 50, the flexed portion 49 located at the second set position 94 contacts with the left lateral side of the third rib 103.

Figure 8A:
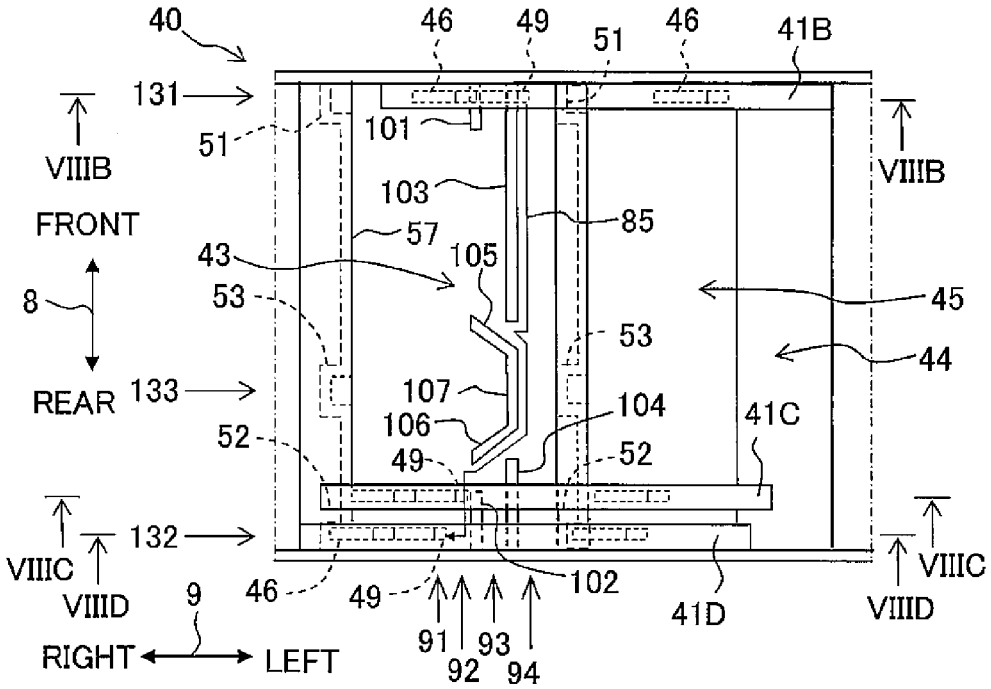
FIG. 8A is another plan view schematically depicting the lock mechanism 40.
Figure 8B:
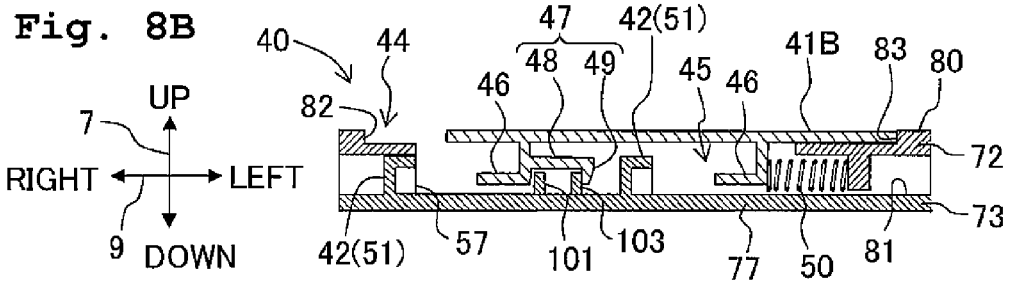
FIG. 8B is a cross-sectional view along the line VIIIB-VIIIB of FIG. 8A.
Figure 8C:
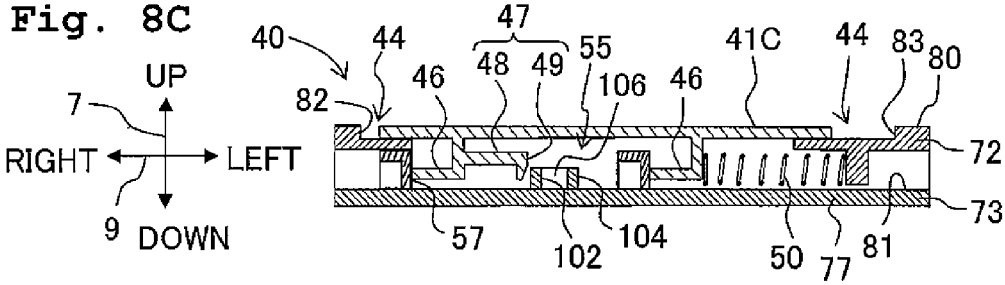
FIG. 8C is a cross-sectional view along the line VIIIC-VIIIC of FIG. 8A.
Figure 8D:
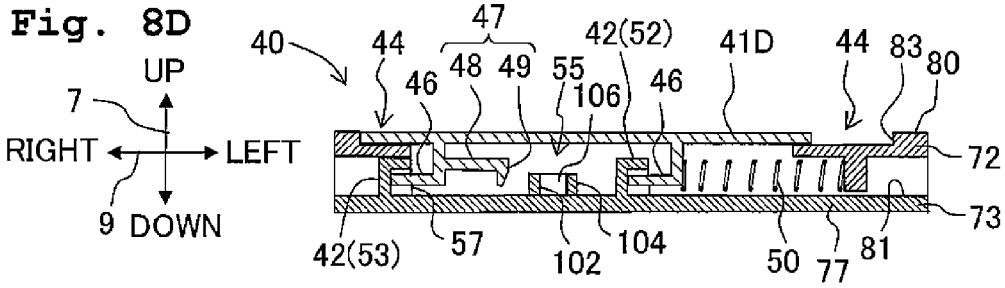
FIG. 8D is a cross-sectional view along the line VIIID-VIIID of FIG. 8A.

Next, if the user moves the second tray 73 frontward, then, as will be described below in detail, the flexed portion 49 makes a relative movement along the guide portion 43 in a direction indicated by the arrow 85 in FIG. 8A.

First, the flexed portion 49 makes a rearward relative movement along the left lateral side of the third rib 103. On passing through the sixth guide position 136, the flexed portion 49 is caused to move rightward by the biasing force of the biasing member 50 to contact with the fifth rib 105. Further, the moving member 41 also moves rightward.

In this state, if the second tray 73 is further moved frontward, then the flexed portion 49 makes an obliquely rearward and leftward relative movement along the left lateral side of the fifth rib 105. Then, the flexed portion 49 makes a rearward relative movement along the left lateral side of the seventh rib 107. Then, the flexed portion 49 makes an obliquely rearward and rightward relative movement along the left lateral side of the sixth rib 106. By virtue of this, the flexed portion 49 moves from the second set position 94 to the first set position 93. Further, the moving member 41 also moves rightward.

When the flexed portion 49 is located at the rear side of the sixth rib 106, the flexed portion 49 is caused to move rightward by the biasing force of the biasing member 50. By virtue of this, the moving member 41 also moves rightward to be located at the position indicated by the reference "41C" in FIG. 8A, that is, in the position depicted in FIG. 8C. That is, the flexed portion 49 moves from the first set position 93 to the unlocking position 92. At this time, the fore-end of the engaging portion 46 contacts with the right peripheral portion 57. Therefore, the flexed portion 49 is not allowed to move from the unlocking position 92 to the locking position 91.

In this state, when the second tray 73 is further moved frontward, then the engaging portion 46 makes a rearward relative movement along the left lateral side of the right peripheral portion 57. When the second tray 73 arrives in the second position, the biasing force of the biasing member 50 causes the engaging portion 46 to leave the right peripheral portion 57 and come into the recess provided at the lateral side of the second engaging-target portion 52. By virtue of this, the moving member 41 also moves rightward so as to be located at the position indicated by the reference "41D" in FIG. 8A, that is, in the position depicted in FIG. 8D. That is, the flexed portion 49 moves from the unlocking position 92 to the locking position 91. As a result, the second tray 73 is locked in the second position and stopped from moving relative to the first tray 72 in the front-rear direction 8.

Further, regarding the process of locking, in the first position, the second tray 73 locked by the lock mechanism 40 in the second position, the operation of each element constituting the feed tray 20 is almost the same as the operation mentioned above except that: (i) the second tray 73 moves rearward; and (ii) the flexed portion 49 makes a relative movement while contacting sequentially with the fourth rib 104, the sixth rib 106, the seventh rib 107, the fifth rib 105, and the right peripheral portion 57. Further, regarding the process of locking, in the first position or in the second position, the second tray 73 locked by the lock mechanism 40 in the third position, the operation of each element constituting the feed tray 20 is almost the same as the operation mentioned above except the following sequences or orders that: (i) the flexed portion 49 makes a relative movement while contacting with the seventh rib 107 and the fifth rib 105 and then the engaging portion 46 comes to contact with the right peripheral portion 57, or (ii) the flexed portion 49 makes a relative movement while contacting the seventh rib 107 and the sixth rib 106 and then the engaging portion 46 comes to contact with the right peripheral portion 57. Hence, any detailed explanation on those operations will be omitted herein.

Effects of the Embodiment

According to this embodiment, if the user moves the second tray 73 from the first position or the second position to the third position, then at first the moving member 41 is moved to cause the flexed portion 49 to move from the locking position 91 to the first set position 93. By virtue of this, the second tray 73 is released from being locked and stopped from moving relative to the first tray 72. Next, the second tray 73 is moved to the third position. At this time, the flexed portion 49 is guided by the first guide portion 54 from the first set position 93 to the locking position 91. As a result, the engaging portions 46 provided on the moving member 41 engage with the third engaging-target portions 53 so as to lock the second tray 73 in the third position to stop the same from moving relative to the first tray 72.

On the other hand, when the user moves the second tray 73 from the first position to the second position, from the second position to the first position, from the third position to the first position, or from the third position to the second position, then at first the moving member 41 is moved to cause the flexed portion 49 to move from the locking position 91 to the second set position 94. By virtue of this, the second tray 73 is released from being locked and stopped from moving relative to the first tray 72. Next, the second tray 73 is moved to the first position or the second position. At this time, the flexed portion 49 is guided by the second guide portion 55 from the second set position 94 to the locking position 91. As a result, the engaging portions 46 provided on the moving member 41 engage with the first engaging-target portions 51 or the second engaging-target portions 52 so as to lock the second tray 73 in the first position or in the second position to stop the second tray 73 from moving relative to the first tray 72.

Here, in the course of moving the second tray 73 to the first position or the second position, when the second tray 73 is located at the third position, the flexed portion 49 is not located at the locking position 91. Hence, when the second tray 73 is moved to the first position or the second position, it is possible to prevent the second tray 73 from being mistakenly locked in the third position.

Further, in the course of moving the second tray 73 to the first position or to the second position, whenever the second tray 73 is located at the third position, even when the flexed portion 49 is not located at the locking position 91, the flexed portion 49 is liable to move to the locking position 91 due to incorrect operation of the user from then. In this embodiment, because the second guide portion 55 includes the seventh rib 107, it is possible to prevent the flexed portion 49 from mistakenly moving to the locking position 91 as described above.

Further, according to this embodiment, even when the user does not manually move the moving member 41, the biasing member 50 can automatically cause the flexed portion 49 to move to the locking position 91.

Further, according to this embodiment, because the flexed portion 49 is movable in a direction away from the guide portion 43, when the moving member 41 moves, the flexed portion 49 can move from the locking position 91 to pass over the first rib 101 and the second rib 102 and come to the first set position 93. Further, the flexed portion 49 can move from the first set position 93 to pass over the third rib 103 and the fourth rib 104 and come to the second set position 94.

Further, when the flexed portion 49 is set at the first set position 93, and when the second tray 73 is moved from the first position or the second position to the third position, then the flexed portion 49 moves from the first set position 93 to the locking position 91 via the unlocking position 92 while maintaining the state of contact with the first rib 101, the second rib 102, and the right peripheral portion 57 due to the biasing member 50. That is, by moving the second tray 73 toward the third position after setting the flexed portion 49 at the first set position 93, it is possible to lock the second tray 73 in the third position.

Further, when the flexed portion 49 set at the second set position 94, and when the second tray 73 is moved from the first position to the second position, from the second position to the first position, from the third position to the first position, or from the third position to the second position, then the flexed portion 49 moves from the second set position 94 to the locking position 91 via the first set position 93 and the unlocking position 92 while maintaining the state of contact with the right peripheral portion 57 and the fourth rib 104 to the seventh rib 107 due to the biasing member 50. That is, by moving the second tray 73 toward the first position or the second position after setting the flexed portion 49 at the second set position 94, it is possible to lock the second tray 73 in the first position or in the second position without locking the second tray 73 in the third position.

Further, when the second tray 73 is located at the third position, the seventh rib 107 can prevent the flexed portion 49 at the second set position 94 from moving toward the locking position 91.

Further, by letting the moving direction of the moving member 41 be the left-right direction 9 orthogonal to the moving orientation of the second tray 73 as in this embodiment, it is possible to simplify the configuration of the lock mechanism 40.

Further, according to this embodiment, because the user moves the moving member 41 in the left-right direction 9 while referring to the indicative portion 90, it is possible to reduce the possibility of moving the moving member 41 to any incorrect position.

First Modification

The first tray 72 is arranged to overlap with the second tray 73 from above in the above embodiment. However, the second tray 73 may be arranged to overlap with the first tray 72 from above.

Second Modification

The moving member 41 is supported by the first tray 72 in the above embodiment. However, the moving member 41 may be supported by the second tray 73. In this case, the engaging-target portions 42 and the guide portion 43 should be provided on the first tray 72 but not on the second tray 73.

Third Modification

In the above embodiment, the guide portion 43 moves in the front-rear direction 8 whereas the moving member 41 does not move in the front-rear direction 8. However, contrary to the above, the moving member 41 may move in the front-rear direction 8 whereas the guide portion 43 does not move in the front-rear direction 8. Such a configuration can be realized by, for example, letting the second tray 73 support the moving member 41 and providing the guide portion 43 on the first tray 72.

Fourth Modification

The moving member 41 may move in any direction intersecting the front-rear direction 8 other than the left-right direction 9.

Fifth Modification

In the above embodiment, the moving portion of the present teaching includes the flexed portion 49, and the guide portion 43 of the present teaching mainly includes the ribs 101 to 107. However, without being limited to such a configuration, the moving portion of the present teaching may be, for example, steps formed in the lower surface of the moving member 41. Further, the guide portion 43 of the present teaching may be steps formed in the upper surface 81 of the bottom plate 77 of the second tray 73.

Sixth Modification

The projection 47 is caused to move upward by the bending of the extension portion 48 in the above embodiment. However, it may be caused to move upward by other manners than the bending. Foe example, the projection 47 may be constructed of a coil spring of which one end is fitted on the lower surface of the moving member 41, and a contact piece which is fitted on the other end of the coil spring. Then, when pressed against the first rib 101 in contact with the contact piece, the contact piece may be caused to move upward by the compressing of the coil spring.

Seventh Modification

In order from the right there are the locking position 91, the unlocking position 92, the first set position 93, and the second set position 94 in the above embodiment. However, the positional relation between the respective positions 91 to 94 may be other than the above.

Eighth Modification

The moving member 41 is biased rightward by the biasing member 50 provided in the lock mechanism 40 in the above embodiment. However, the lock mechanism 40 need not necessarily include the biasing member 50.

An explanation will be made below with respect to the configuration of the lock mechanism 40 without the biasing member 50, and the operation of each element constituting the feed tray 20 in the course of the second tray 73 moving relative to the first tray 72, focused chiefly on the difference from the above embodiment.

In the eighth modification, the first guide portion 54 and the second guide portion 55 include inclined surfaces.

The first guide portion 54 includes a first inclined surface 111 (an example of the first inclined portion of the present teaching), a second inclined surface 112 (an example of the second inclined portion of the present teaching), a third inclined surface 113 (an example of the third inclined portion of the present teaching), and a fourth inclined surface 114 (an example of the fourth inclined portion of the present teaching).

The first inclined surface 111 is located between the first guide position 131 and the third guide position 133 in the front-rear direction 8. The front-end of the first inclined surface 111 is located between the first set position 93 and the second set position 94 in the left-right direction 9. The rear-end of the first inclined surface 111 is located between the first set position 93 and the unlocking position 92 in the left-right direction 9. In other words, the first inclined surface 111 is inclined obliquely rearward and rightward from its front-end to its rear-end.

The second inclined surface 112 is located between the first inclined surface 111 and the third guide position 133 in the front-rear direction 8. The front-end of the second inclined surface 112 is located between the unlocking position 92 and the first set position 93 in the left-right direction 9. The rear-end of the second inclined surface 112 is located between the unlocking position 92 and the locking position 91 in the left-right direction 9. In other words, the second inclined surface 112 is inclined obliquely rearward and rightward from its front-end to its rear-end.

The third inclined surface 113 is located between the second guide position 132 and the third guide position 133 in the front-rear direction 8. The front-end of the third inclined surface 113 is located between the first set position 93 and the unlocking position 92 in the left-right direction 9. The rear-end of the third inclined surface 113 is located between the first set position 93 and the second set position 94 in the left-right direction 9. In other words, the third inclined surface 113 is inclined obliquely rearward and leftward from its front-end to its rear-end.

The fourth inclined surface 114 is located between the third inclined surface 113 and the third guide position 133 in the front-rear direction 8. The front-end of the fourth inclined surface 114 is located between the unlocking position 92 and the locking position 91 in the left-right direction 9. The end of the fourth inclined surface 114 at the rear side is located between the unlocking position 92 and the first set position 93 in the left-right direction 9. In other words, the fourth inclined surface 114 is inclined obliquely rearward and leftward from its front-end to its rear-end.

The second guide portion 55 includes a fifth inclined surface 115 (an example of the fifth inclined portion of the present teaching), a sixth inclined surface 116 (an example of the sixth inclined portion of the present teaching), a seventh inclined surface 117 (an example of the seventh inclined portion of the present teaching), an eighth inclined surface 118 (an example of the eighth inclined portion of the present teaching), a ninth inclined surface 119 (an example of the ninth inclined portion of the present teaching), a tenth inclined surface 120 (an example of the tenth inclined portion of the present teaching), an eleventh inclined surface 121 (an example of the eleventh inclined portion of the present teaching), and a twelfth inclined surface 122 (an example of the twelfth inclined portion of the present teaching).

The fifth inclined surface 115 is located between the first guide position 131 and the third guide position 133 in the front-rear direction 8. The front-end of the fifth inclined surface 115 is located at the left side of the second set position 94 in the left-right direction 9. The rear-end of the fifth inclined surface 115 is located between the second set position 94 and the first set position 93 in the left-right direction 9. In other words, the fifth inclined surface 115 is inclined obliquely rearward and rightward from its front-end to its rear-end.

The sixth inclined surface 116 is situated between the third guide position 133 and the third inclined surface 113 (moreover, between the third inclined surface 113 and the fourth inclined surface 114) in the front-rear direction 8. The front-end of the sixth inclined surface 116 is located between the first set position 93 and the second set position 94 in the left-right direction 9. The rear-end of the sixth inclined surface 116 is located between the first set position 93 and the unlocking position 92 in the left-right direction 9. In other words, the sixth inclined surface 116 is inclined obliquely rearward and rightward from its front-end to its rear-end.

The seventh inclined surface 117 is located between the front end of the third inclined surface 113 and the second guide position 132 in the front-rear direction 8. The front-end of the seventh inclined surface 117 is located between the unlocking position 92 and the first set position 93 in the left-right direction 9. The rear-end of the seventh inclined surface 117 is located between the unlocking position 92 and the locking position 91 in the left-right direction 9. In other words, the seventh inclined surface 117 is inclined obliquely rearward and rightward from its front-end to its rear-end.

The eighth inclined surface 118 is located between the second guide position 132 and the third guide position 133 (moreover, between the front end of the sixth inclined surface 116 and the rear end of the fourth inclined surface 114) in the front-rear direction 8. The front-end of the eighth inclined surface 118 is located between the second set position 94 and the first set position 93 in the left-right direction 9 while the rear-end of the eighth inclined surface 118 is located at the left side of the second set position 94 in the left-right direction 9. In other words, the eighth inclined surface 118 is inclined obliquely rearward and leftward from its front-end to its rear-end.

The ninth inclined surface 119 is located between the first guide position 131 and the third guide position 133 (moreover, between the front end of the first inclined surface 111 and the rear end of the fifth inclined surface 115) in the front-rear direction 8. The front-end of the ninth inclined surface 119 is located between the first set position 93 and the unlocking position 92 in the left-right direction 9. The rear-end of the ninth inclined surface 119 is located between the first set position 93 and the second set position 94 in the left-right direction 9. In other words, the ninth inclined surface 119 is inclined obliquely rearward and leftward from its front-end to its rear-end.

The tenth inclined surface 120 is located between the first guide position 131 and the third guide position 133 (moreover, between the first guide position 131 and the front end of the first inclined surface 111) in the front-rear direction 8. The front-end of the tenth inclined surface 120 is located between the unlocking position 92 and the locking position 91 in the left-right direction 9. The rear-end of the tenth inclined surface 120 is located between the first set position 93 and the unlocking position 92 in the left-right direction 9. In other words, the tenth inclined surface 120 is inclined obliquely rearward and leftward from its front-end to its rear-end.

The eleventh inclined surface 121 is located between the first guide position 131 and the third guide position 133 (moreover, between the third guide position 133 and the rear end of the fifth inclined surface 115) in the front-rear direction 8. The front-end of the eleventh inclined surface 121 is situated between the second set position 94 and the first set position 93 in the left-right direction 9. The rear-end of the eleventh inclined surface 121 is located at the left side of the second set position 94 in the left-right direction 9. In other words, the eleventh inclined surface 121 is inclined obliquely rearward and leftward from its front-end to its rear-end.

The twelfth inclined surface 122 is located between the second guide position 132 and the third guide position 133 (moreover, between the third guide position 133 and the front end of the eighth inclined surface 118) in the front-rear direction 8. The front-end of the twelfth inclined surface 122 is located at the left side of the second set position 94 in the left-right direction 9. The rear-end of the twelfth inclined surface 122 is located between the second set position 94 and the first set position 93 in the left-right direction 9. In other words, the twelfth inclined surface 122 is inclined obliquely rearward and rightward from its front-end to its rear-end.

Further, in the eighth modification, the projection 47 is a protrusion extending downward from the lower surface of the moving member 41. That is, the projection 47 in the above embodiment includes the extension portion 48 and the flexed portion 49, and the flexed portion 49 which is a part of the projection 47 corresponds to the moving portion of the present teaching, whereas the entire projection 47 in the eighth modification corresponds to the moving portion of the present teaching.

Referring to FIGS. 9A to 9D, an explanation will be made below on the operation of each element constituting the feed tray 20 in the process of locking, in the third position, the second tray 73 locked by the lock mechanism 40 in the first position.

In the initial state, the second tray 73 is located at the first position. On this occasion, the moving member 41 is located right above the first guide position 131 according to the front-rear direction 8. Further, the projection 47 provided on the moving member 41 is located at the locking position 91 according to the left-right direction 9. Therefore, the fore-end of the engaging portion 46 is inserted in the recess provided at the lateral side of the first engaging-target portion 51. By virtue of this, the second tray 73 is locked and stopped from moving relative to the first tray 72 in the front-rear direction 8.

In the above initial state, when the user of the multifunction printer 10 moves the moving member 41 leftward, then the projection 47 also moves leftward. The user moves the projection 47 from the locking position 91 to the first set position 93. By virtue of this, the moving member 41 is located at the position indicated by the reference "41B" in FIG. 9A, that is, in the position depicted in FIG. 9B, and the engaging portion 46 is separated from the first engaging-target portion 51. As a result, the second tray 73 is unlocked and becomes movable relative to the first tray 72 in the front-rear direction 8.

Figure 9A:
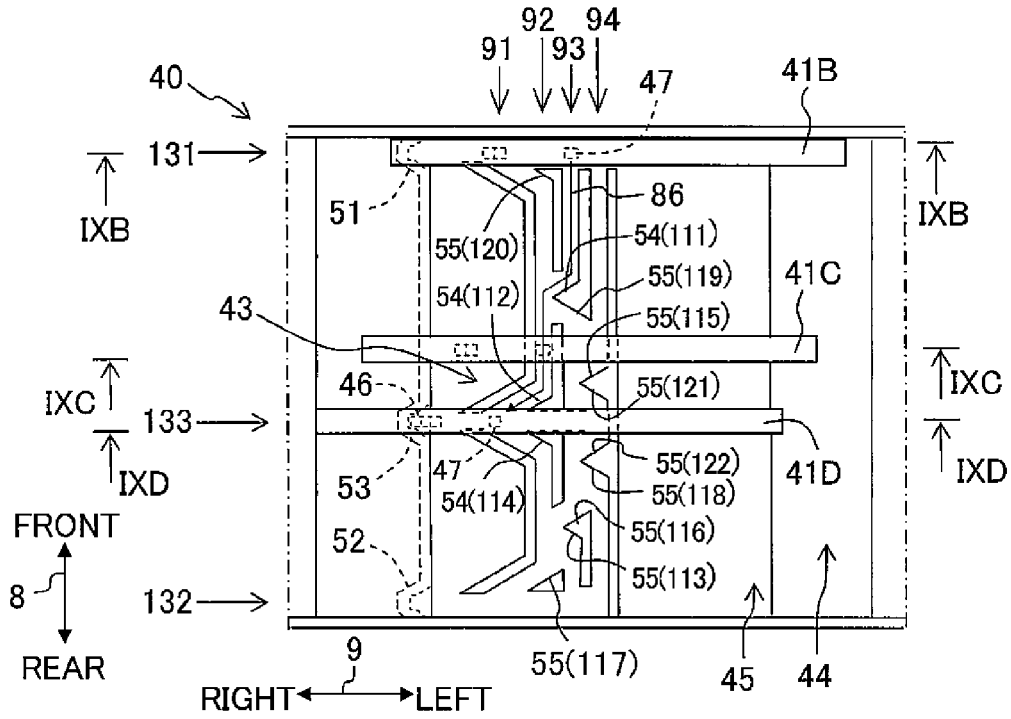
FIG. 9A is a plan view schematically depicting the lock mechanism 40 according to an eighth modification.
Figure 9B:
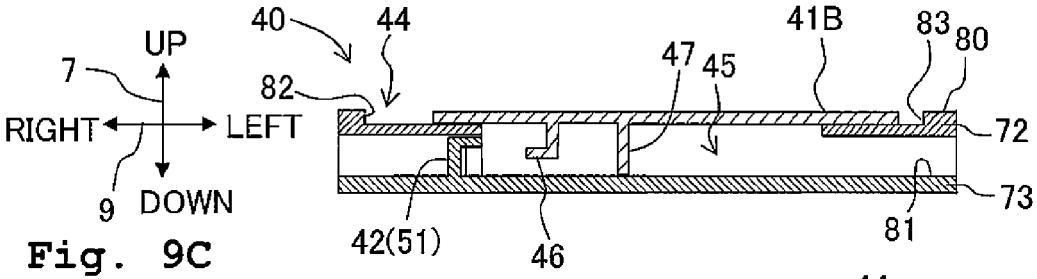
FIG. 9B is a cross-sectional view along the line IXB-IXB of FIG. 9A.
Figure 9C:
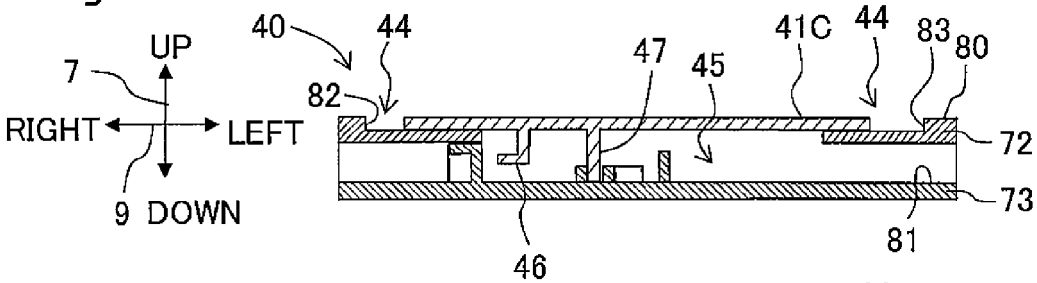
FIG. 9C is a cross-sectional view along the line IXC-IXC of FIG. 9A.
Figure 9D:
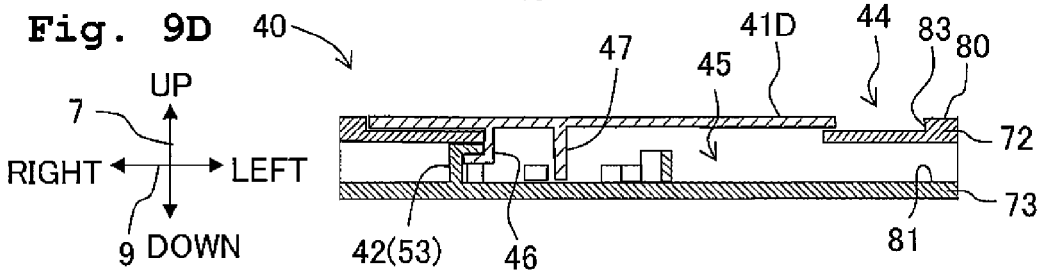
FIG. 9D is a cross-sectional view along the line IXD-IXD of FIG. 9A.

Next, when the user moves the second tray 73 frontward, then, as will be described below in detail, the projection 47 makes a relative movement along the guide portion 43 in a direction indicated by the arrow 86 in FIG. 9A.

First, the projection 47 makes a rearward relative movement to contact with the first inclined surface 111. In this state, when the second tray 73 is moved frontward, then the projection 47 makes an obliquely rearward and rightward relative movement along the first inclined surface 111. As a result, the projection 47 moves from the first set position 93 to the unlocking position 92 in the left-right direction 9.

In this state, when the second tray 73 is moved frontward, then the projection 47 makes a rearward relative movement. During this course, the moving member 41 is located at the position indicated by the reference "41C" in FIG. 9A, that is, in the position depicted in FIG. 9C. Then, the projection 47 comes to contact with the second inclined surface 112. In this state, when the second tray 73 is moved frontward, then the projection 47 makes an obliquely rearward and rightward relative movement along the second inclined surface 112. By virtue of this, the projection 47 moves from the unlocking position 92 to the locking position 91 in the left-right direction 9. As a result, the moving member 41 is located at the position indicated by the reference "41D" in FIG. 9A, that is, in the position depicted in FIG. 9D. At this time, the second tray 73 is located at the third position. As a result, the second tray 73 is locked in the third position and stopped from moving relative to the first tray 72 in the front-rear direction 8.

Further, in the process of locking, in the third position, the second tray 73 locked by the lock mechanism 40 in the second position, the operation of each element constituting the feed tray 20 is almost the same as the operation mentioned above except that: (i) the second tray 73 moves rearward, and (ii) the projection 47 makes a relative movement while sequentially contacting with the third inclined surface 113 and the fourth inclined surface 114. Hence, any detailed explanation on that operation will be omitted herein.

Next, referring to FIGS. 10A to 10D, an explanation will be made on the operation of each element constituting the feed tray 20 in the process of locking, in the second position, the second tray 73 locked by the lock mechanism 40 in the first position.

The initial state is the same as the case of FIGS. 9A to 9D.

In this initial state, when the user of the multifunction printer 10 moves the moving member 41 leftward, then the projection 47 also moves leftward. The user moves the projection 47 from the locking position 91 to the second set position 94. By virtue of this, the moving member 41 is located at the position indicated by the reference "41B" in FIG. 10A, that is, in the position depicted in FIG. 10B, and the engaging portion 46 is separated from the first engaging-target portion 51. As a result, the second tray 73 is unlocked and becomes movable relative to the first tray 72 in the front-rear direction 8.

Figure 10A:
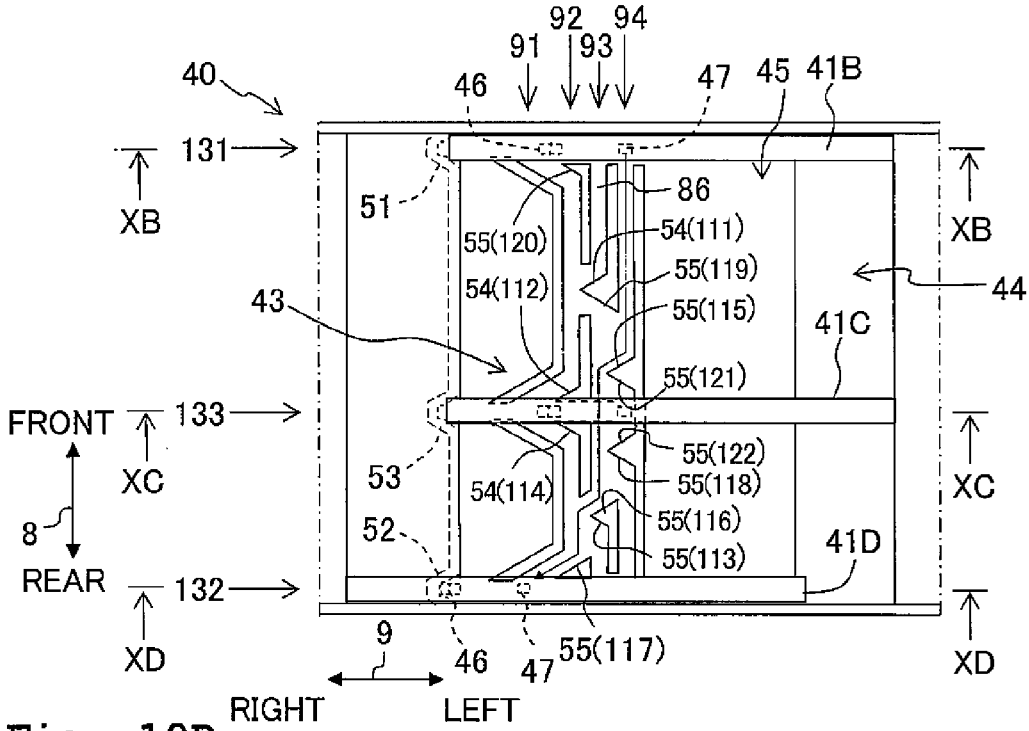
FIG. 10A is another plan view schematically depicting the lock mechanism 40 according to the eighth modification.
Figure 10B:
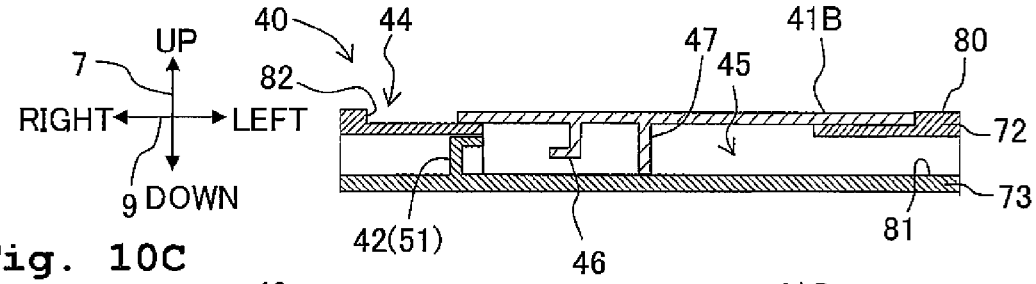
FIG. 10B is a cross-sectional view along the line XB-XB of FIG. 10A.
Figure 10C:
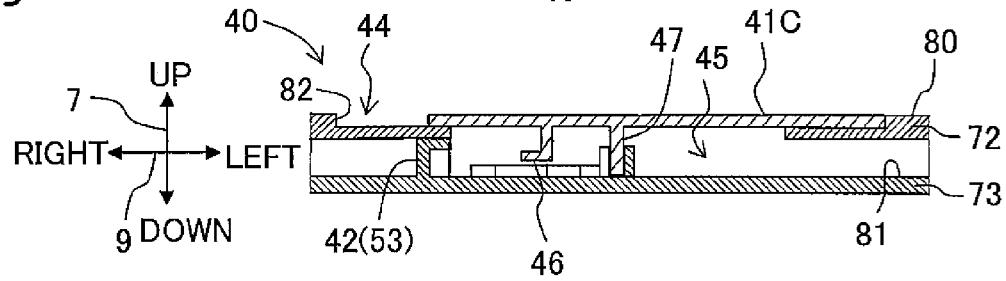
FIG. 10C is a cross-sectional view along the line XC-XC of FIG. 10A.
Figure 10D:
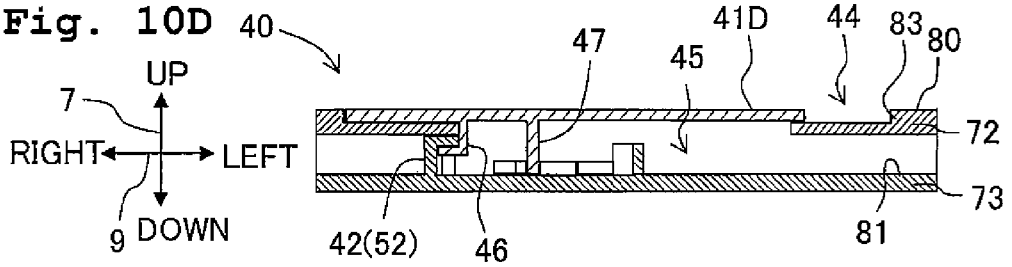
FIG. 10D is a cross-sectional view along the line XD-XD of FIG. 10A.
Figure 11:
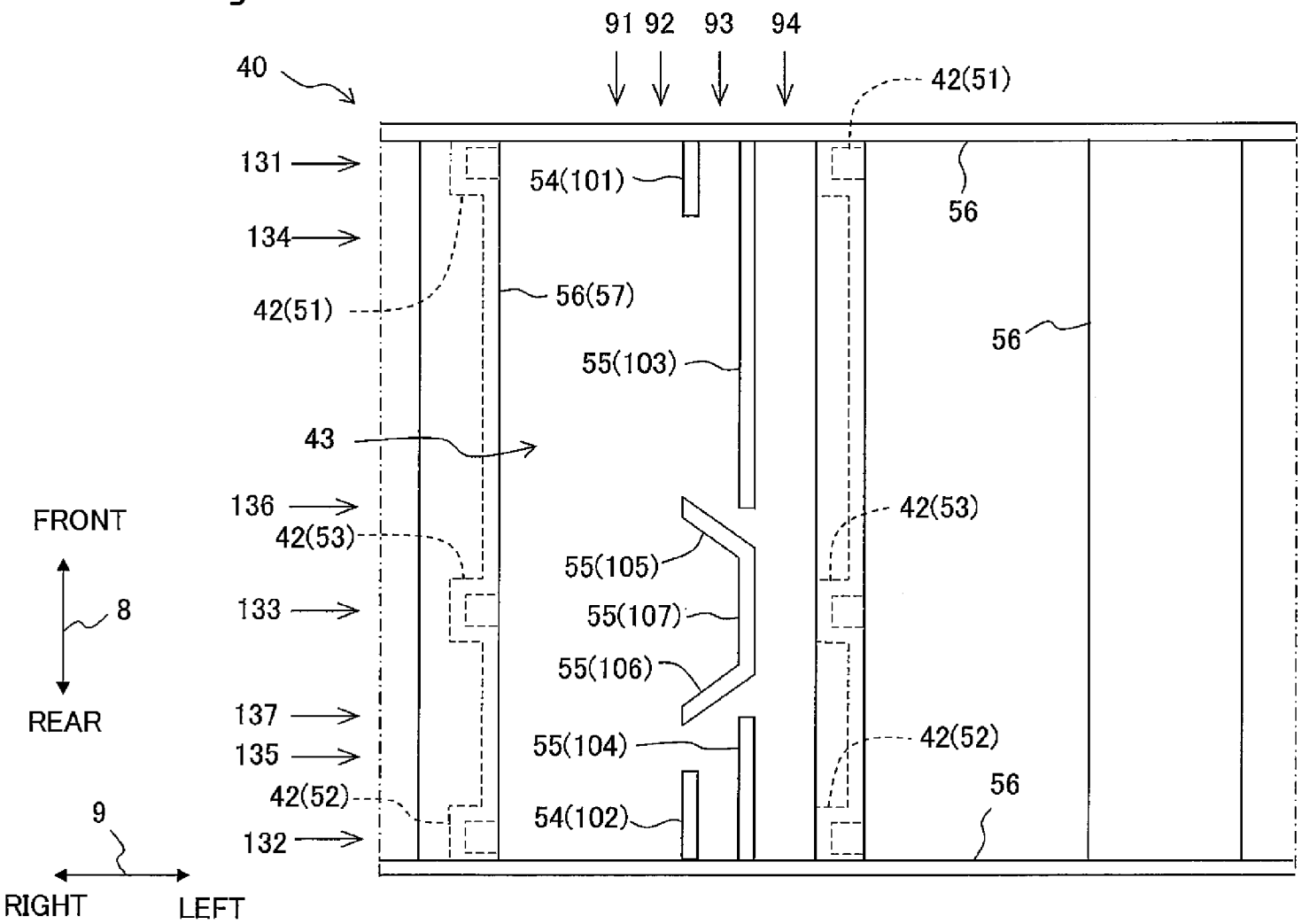
FIG. 11 is a plan view schematically depicting engaging-target portions 42 and a guide portion 43.

Next, when the user moves the second tray 73 frontward, then, as will be described below in detail, the projection 47 makes a relative movement along the guide portion 43 in a direction indicated by a trajectory 87 in FIG. 10A.

First, the projection 47 makes a rearward relative movement to contact with the fifth inclined surface 115. In this state, when the second tray 73 is moved frontward, then the projection 47 makes an obliquely rearward and rightward relative movement along the fifth inclined surface 115. Then, when the second tray 73 is moved frontward, then the projection 47 makes a rearward relative movement along a trajectory 87. As a result, the projection 47 moves from the second set position 94 to the first set position 93 in the left-right direction 9.

In this state, when the second tray 73 is moved frontward, then the projection 47 comes to contact with the sixth inclined surface 116. In this state, when the second tray 73 is moved frontward, then the projection 47 makes an obliquely rearward and rightward relative movement along the sixth inclined surface 116. As a result, the projection 47 moves from the first set position 93 to the unlocking position 92 in the left-right direction 9.

In this state, when the second tray 73 is moved frontward, then the projection 47 comes to contact with the seventh inclined surface 117. In this state, when the second tray 73 is moved frontward, then the projection 47 makes an obliquely rearward and rightward relative movement along the seventh inclined surface 117. As a result, the projection 47 moves from the unlocking position 92 to the locking position 91 in the left-right direction 9. As a result, the moving member 41 is located at the position indicated by the reference "41D" in FIG. 10A, that is, in the position depicted in FIG. 10D. At this time, the second tray 73 is located at the second position. As a result, the second tray 73 is locked in the second position and stopped from moving relative to the first tray 72 in the front-rear direction 8.

Further, in the process of locking, in the first position, the second tray 73 locked by the lock mechanism 40 in the second position, the operation of each element constituting the feed tray 20 is almost the same as the operation mentioned above except that: (i) the second tray 73 moves rearward; and (ii) the projection 47 makes a relative movement while sequentially contacting with the eighth inclined surface 118, the eleventh inclined surface 121, the ninth inclined surface 119, and the tenth inclined surface 120. Further, in the process of locking, in the first position or the second position, the second tray 73 locked by the lock mechanism 40 in the third position, the operation of each element constituting the feed tray 20 is almost the same as the operation mentioned above except that: (i) the projection 47 makes a relative movement while sequentially contacting with the eleventh inclined surface 121, the ninth inclined surface 119, and the tenth inclined surface 120; or (ii) the projection 47 makes a relative movement while sequentially contacting with the twelfth inclined surface 122, the sixth inclined surface 116, and the seventh inclined surface 117. Hence, any detailed explanation on that operation will be omitted herein.

According to the eighth modification, when the projection 47 is set at the first set position 93, and when the second tray 73 is moved from the first position or the second position toward the third position, then the projection 47 moving along the moving orientation of the second tray 73 moves from the first set position 93 to the unlocking position 92 by contact with the first inclined surface 111 or the third inclined surface 113. Then the projection 47 moves from the unlocking position 92 to the locking position 91 by contact with the second inclined surface 112 or the fourth inclined surface 114. That is, by moving the second tray 73 toward the third position after setting the projection 47 at the first set position 93, it is possible to lock the second tray 73 in the third position.

Further, let us consider a case in which the projection 47 is set at the second set position 94, and the second tray 73 is moved from the first position to the second position, from the second position to the first position, from the third position to the first position, or from the third position to the second position. In these case, the projection 47 moving along the moving orientation of the second tray 73 moves from the second set position 94 to the first set position 93 by contact with the fifth inclined surface 115, the eighth inclined surface 118, the eleventh inclined surface 121, or the twelfth inclined surface 122, moves from the first set position 93 to the unlocking position 92 by contact with the sixth inclined surface 116 or the ninth inclined surface 119, and moves from the unlocking position 92 to the locking position 91 by contact with the seventh inclined surface 117 or the tenth inclined surface 120. That is, by moving the second tray 73 toward the first position or the second position after setting the projection 47 at the second set position 94, it is possible to lock the second tray 73 in the first position or the second position without locking the same in the third position.

What is claimed is:

1. A feed tray comprising:

a first tray including a first support surface configured to support a sheet;

a second tray including a second support surface configured to support the sheet, and being configured to be movable among a first position, a second position and a third position;

the first position being a position at which the second support surface overlaps with the first support surface, the second position being a position at which an area of the second support surface overlapping with the first support surface is smaller than in the first position, and the third position being a position at which the area of the second support surface overlapping with the first support surface is smaller than in the first position but larger than in the second position; and a lock mechanism configured to lock the second tray to stop the second tray from moving, wherein the lock mechanism comprises:

a moving member supported by one of the first tray and the second tray, and configured to move in an intersectant direction intersecting a moving direction of the second tray;

an engaging portion provided on the moving member and configured to engage with the other of the second tray and the first tray;

an engaging-target portion provided on the other of the second tray and the first tray and configured to engage with the engaging portion to lock the second tray to stop the second tray from moving;

a moving portion configured to move with the moving member among a locking position at which the engaging portion is engageable with the engaging-target portion, a first set position at which the engaging portion does not engage with the engaging-target portion, and a second set position which is different from the first set position and at which the engaging portion does not engage with the engaging-target portion either; and a guide portion provided on the other of the second tray and the first tray to guide the moving portion to the locking position in the course of movement of the second tray, wherein the engaging-target portion comprises:

a first engaging-target portion engaging with the engaging portion with the second tray located at the first position and with the moving portion located at the locking position;

a second engaging-target portion engaging with the engaging portion with the second tray located at the second position and with the moving portion located at the locking position; and a third engaging-target portion engaging with the engaging portion with the second tray located at the third position and with the moving portion located at the locking position, wherein the guide portion comprises:

a first guide portion configured to guide the moving portion at the first set position to the locking position in the course of the second tray moving from the first position or the second position to the third position; and a second guide portion configured to guide the moving portion at the second set position to the locking position in a case that the second tray moves to the first position or the second position, but not to guide the moving portion at the second set position to the locking position with the second tray located at the third position, in the course of the second tray moving from the second position or the third position to the first position, and in the course of the second tray moving from the first position or the third position to the second position.

2. The feed tray according to claim 1, wherein the second guide portion comprises a movement impediment portion configured to impede the moving portion from moving to the locking position with the second tray located at the third position.

3. The feed tray according to claim 2, wherein the lock mechanism further comprises a biasing member configured to bias the moving member in a direction that the moving portion heads toward the locking position.

4. The feed tray according to claim 3, wherein the moving portion is movable to an unlocking position between the locking position and the first set position at which the engaging portion does not engage with the engaging-target portion, wherein in the moving orientation of the second tray, in a case that the second tray is located at the first position, the moving portion is located at a first guide position in the guide portion, wherein in a case that the second tray is located at the second position, the moving portion is located at a second guide position in the guide portion, wherein the second tray is located at the third position, the moving portion is located at a third guide position in the guide portion, wherein one of the moving portion and the guide portion is movable in a direction as away from the other of the moving portion and the guide portion, wherein the second set position is located at the opposite side from the locking position across the first set position, wherein the guide portion comprises a guide rib extending between the locking position and the unlocking position over the entire range from the first guide position to the third guide position and over the entire range from the second guide position to the third guide position, wherein the first guide portion comprises: a first rib and a second rib, the first rib extending, in a range between the unlocking position and the first set position, from the first guide position to a fourth guide position between the first guide position and the third guide position, and the second rib extending, in a range between the unlocking position and the first set position, from the second guide position to a fifth guide position between the second guide position and the third guide position, wherein the second guide portion comprises: a third rib, a fourth rib, a fifth rib and a sixth rib, the third rib extending, in a range between the first set position and the second set position, from the first guide position to a sixth guide position between the fourth guide position and the third guide position, the fourth rib extending, in a range between the first set position and the second set position, from the second guide position to a seventh guide position between the fifth guide position and the third guide position, the fifth rib extending from a position to another position, the position being located between the first set position and the second set position, and being located between the third rib and the third guide position, and the another position being located between the unlocking position and the first set position, and being located between the sixth guide position and the fourth guide position, the fifth rib being inclined so as to be located at the side of the locking position as much as at the side of the first guide position, and the sixth rib extending from a position to another position, the position of the sixth rib being located between the first set position and the second set position, and being located between the fourth rib and the third guide position, the another position of the sixth rib being located between the unlocking position and the first set position, and being located between the seventh guide position and the fifth guide position, the sixth rib being inclined so as to be located at the side of the locking position as much as at the side of the second guide position; and wherein the movement impediment portion comprises a seventh rib arranged between the first set position and the second set position to connect the fifth rib and the sixth rib.

5. The feed tray according to claim 1, wherein the moving portion is movable to an unlocking position between the locking position and the first set position at which the engaging portion does not engage with the engaging-target portion, wherein in the moving orientation of the second tray, in a case that the second tray is located at the first position, the moving portion is located at a first guide position in the guide portion, wherein in a case that the second tray is located at the second position, the moving portion is located at a second guide position in the guide portion, wherein in a case that the second tray is located at the third position, the moving portion is located at a third guide position in the guide portion, wherein the second set position is located at the opposite side from the locking position across the first set position, wherein the first guide portion comprises: a first inclined portion, a second inclined portion, a third inclined portion, and a fourth inclined portion, the first inclined portion extending, in a range between the first guide position and the third guide position, from a position between the first set position and the second set position to another position between the first set position and the unlocking position, the first inclined portion being inclined so as to come as close to the locking position as close to the third guide position, the second inclined portion extending, in a range between the first inclined portion and the third guide position, from a position between the unlocking position and the first set position to another position between the unlocking position and the locking position, the second inclined portion being inclined so as to come as close to the locking position as close to the third guide position, the third inclined portion extending, in a range between the second guide position and the third guide position, from a position between the first set position and the second set position to another position between the first set position and the unlocking position, the third inclined portion being inclined so as to come as close to the locking position as close to the third guide position, and the fourth inclined portion extending, in a range between the third inclined portion and the third guide position, from a position between the unlocking position and the first set position to another position between the unlocking position and the locking position, the fourth inclined portion being inclined so as to come as close to the locking position as close to the third guide position;

wherein the second guide portion comprises: a fifth inclined portion, a sixth inclined portion, a seventh inclined portion, an eighth inclined portion, a ninth inclined portion, a tenth inclined portion, a eleventh inclined portion and a twelfth inclined portion, the fifth inclined portion extending from a position between the first guide position and the third guide position at the opposite side from the first set position across the second set position, to another position between the second set position and the first set position, the another position being closer to the third guide position than the first inclined portion, the fifth inclined portion being inclined so as to come as close to the locking position as close to the third guide position, the sixth inclined portion extending from a position between the third guide position and the third inclined portion and between the first set position and the second set position, to another position between the third inclined portion and the fourth inclined portion and between the first set position and the unlocking position, the sixth inclined portion being inclined so as to come as close to the locking position as close to the second guide position, the seventh inclined portion extending from a position between an end of the third inclined portion at the side of the third guide position, and the second guide position and between the unlocking position and the first set position, to another position between the unlocking position and the locking position, the seventh inclined portion being inclined so as to come as close to the locking position as close to the second guide position, the eighth inclined portion extending from a position between the second guide position and the third guide position at the opposite side from the first set position across the second set position, to another position between the second set position and the first set position, the another position of the eighth inclined portion being closer to the side of the third guide position than an end of the sixth inclined portion at the side of the third guide position the eighth inclined portion being inclined so as to come as close to the locking position as close to the third guide position, the ninth inclined portion extending from a position between an end of the fifth inclined portion at the side of the third guide position, and the first inclined portion and between the first set position and the second set position, to another position between the first inclined portion and the second inclined portion and between the first set position and the unlocking position, the ninth inclined portion being inclined so as to come as close to the locking position as close to the first guide position, the tenth inclined portion extending from a position between an end of the first inclined portion at the side of the third guide position, and the first guide position and between the unlocking position and the first set position, to another position between the unlocking position and the locking position, the tenth inclined portion being inclined so as to come as close to the locking position as close to the first guide position, the eleventh inclined portion extending from a position between the fifth inclined portion and the third guide position at the opposite side from the first set position across the second set position, to another position between the second set position and the first set position, the eleventh inclined portion being inclined so as to come as close to the locking position as close to the first guide position, the twelfth inclined portion extending from a position between the eighth inclined portion and the third guide position at the opposite side from the first set position across the second set position, to another position between the second set position and the first set position, and the twelfth inclined portion being inclined so as to come as close to the locking position as close to the second guide position.

6. The feed tray according to claim 1, wherein the intersectant direction is orthogonal to the moving orientation of the second tray and along the first support surface.

7. The feed tray according to claim 1, wherein the moving member and at least one of the first tray and the second tray comprise an indicative portion exhibiting respective positions of the moving portion.

8. The feed tray according to claim 1, wherein the moving portion and the engaging portion extend to opposite sides from each other in the intersectant direction.

9. The feed tray according to claim 8, wherein the moving portion comprises an extension portion extending in the intersectant direction above an upper surface of the guide portion, and a flexed portion extending downward from an end of the extension portion at the opposite side from the engaging portion, to a position lower than the upper surface of the guide portion.

10. The feed tray according to claim 9, wherein the extension portion is configured to undergo elastic deformation to bow upward in a case that the flexed portion contacts with the upper surface of the guide portion.

11. The feed tray according to claim 10, wherein the moving portion is formed of a resin material.

* * * * *

UNITED STATES PATENT AND TRADEMARK OFFICE

CERTIFICATE OF CORRECTION

PATENT NO. : 9,033,336 B2
APPLICATION NO. : 14/452017
DATED : May 19, 2015
INVENTOR(S) : Yoshiyuki Washino It is certified that error appears in the above-identified patent and that said Letters Patent is hereby corrected as shown below:

Title page of the patent, add:

(30) Foreign Application Priority Data

Aug. 7, 2013 (JP) ..... 2013-164590

Signed and Sealed this
Sixteenth Day of February, 2016

Michelle K. Lee

Michelle K. Lee
*Director of the United States Patent and Trademark Office*